US011088481B2

(12) United States Patent
Castiglione et al.

(10) Patent No.: US 11,088,481 B2
(45) Date of Patent: Aug. 10, 2021

(54) SCALABLE HIGH-SPEED ELECTRICAL CABLE ASSEMBLY

(71) Applicant: 3M INNOVATIVE PROPERTIES COMPANY, St. Paul, MN (US)

(72) Inventors: Joseph N. Castiglione, Cedar Park, TX (US); Thomas Suniga, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/815,268

(22) Filed: Mar. 11, 2020

(65) Prior Publication Data

US 2020/0295486 A1 Sep. 17, 2020

Related U.S. Application Data

(60) Provisional application No. 62/817,609, filed on Mar. 13, 2019.

(51) Int. Cl.
*H01R 13/00* (2006.01)
*H01R 12/77* (2011.01)
*H01R 13/506* (2006.01)

(52) U.S. Cl.
CPC ..... *H01R 12/774* (2013.01); *H01R 13/506* (2013.01)

(58) Field of Classification Search
CPC ..... H01R 13/506; H01R 12/774
USPC ..... 439/499
See application file for complete search history.

(56) References Cited

U.S. PATENT DOCUMENTS 3,874,762 A * 4/1975 Shott ..... H01R 13/518 439/425
4,621,885 A * 11/1986 Szczesny ..... H01R 12/675 439/357
4,640,562 A * 2/1987 Shoemaker ..... H01R 12/79 439/327
4,781,623 A * 11/1988 Philippson ..... H01R 24/62 439/670
4,889,503 A * 12/1989 Philippson ..... H01R 12/716 439/607.45
5,997,361 A * 12/1999 Driscoll ..... H01R 13/6599 439/358

(Continued)

*Primary Examiner* — Abdullah A Riyami
*Assistant Examiner* — Vladimir Imas
(74) *Attorney, Agent, or Firm* — Jonathan L. Tolstedt

(57) ABSTRACT

A retainer assembly configured to be inserted into a plug housing to form a plug connector includes a retainer housing including a top housing portion and a bottom housing portion, a circuit board partially disposed between the top and bottom housing portions, at least one substantially flat top cable including a plurality of conductors, at least one substantially flat bottom cable including a plurality of conductors, and an adhesive for bonding the conductors to the circuit board. The top and bottom housing portions each define at least one top through opening therein and each include mating latching members. The plurality of conductors of the flat top and bottom cables are terminated at top and bottom termination regions on the circuit board, respectively, and are aligned with and exposed through the corresponding through openings. The adhesive at least partially fills each through opening and bonds the conductors in the corresponding exposed termination region to the circuit board.

8 Claims, 19 Drawing Sheets

(56) References Cited

U.S. PATENT DOCUMENTS 7,094,092 B2 * 8/2006 Yang ..... H01R 12/79 439/495
7,364,465 B2 * 4/2008 Wu ..... H01R 13/6275 439/607.41
7,651,342 B1 * 1/2010 Wu ..... H01R 13/6595 439/76.1
7,651,359 B2 * 1/2010 Scherer ..... H01R 13/639 439/345
7,883,341 B2 * 2/2011 Lang ..... H01R 13/6658 439/76.1
8,215,995 B1 * 7/2012 Little ..... H01R 12/7047 439/638
8,251,730 B2 * 8/2012 Wu ..... H01R 13/6275 439/345
8,393,913 B2 * 3/2013 Wu ..... H01R 13/6594 439/345
8,403,698 B2 * 3/2013 Su ..... H01R 12/594 439/455
8,537,558 B2 * 9/2013 Su ..... H01R 13/6658 361/747
8,550,832 B2 * 10/2013 Regnier ..... H01R 4/2429 439/260
8,668,515 B2 * 3/2014 Wu ..... H01R 13/633 439/352
8,770,990 B2 * 7/2014 Sytsma ..... H01R 9/034 439/76.1
8,794,991 B2 * 8/2014 Ngo ..... H01R 12/75 439/350
8,834,190 B2 * 9/2014 Ngo ..... H01R 12/7023 439/328
9,331,418 B2 * 5/2016 Chung ..... H01R 24/60
9,385,466 B2 * 7/2016 Henry ..... H01R 13/506
9,419,367 B2 * 8/2016 Henry ..... H01R 9/034
10,411,408 B2 * 9/2019 Wu ..... H01R 24/62
10,833,437 B2 * 11/2020 Huang ..... H01R 12/716
2006/0189197 A1 * 8/2006 Reed ..... H01R 13/6275 439/352
2011/0306244 A1 * 12/2011 Zhang ..... H01R 13/65914 439/624
2012/0115359 A1 * 5/2012 Ko ..... H01R 27/02 439/578
2012/0129382 A1 * 5/2012 Regnier ..... H01R 13/7197 439/421
2012/0129396 A1 * 5/2012 Wang ..... H01R 12/515 439/607.01
2012/0149214 A1 * 6/2012 Zhang ..... G02B 6/3817 439/55
2012/0171903 A1 * 7/2012 Wang ..... H01R 13/508 439/660
2012/0244742 A1 * 9/2012 Wertz ..... H05K 7/1061 439/485
2014/0342596 A1 * 11/2014 Mathews ..... H01R 12/772 439/470
2020/0274275 A1 * 8/2020 Kim ..... H01R 13/26

* cited by examiner

SCALABLE HIGH-SPEED ELECTRICAL CABLE ASSEMBLY

SUMMARY

In some aspects of the present description, a retainer assembly configured to be inserted into a plug housing to form a plug connector is provided. The retainer assembly includes a retainer housing including a top housing portion and a bottom housing portion, a circuit board partially disposed between the top and bottom housing portions, at least one substantially flat top cable including a plurality of conductors, at least one substantially flat bottom cable including a plurality of conductors, and an adhesive for bonding the conductors to the circuit board. The top housing portion of the retainer housing defines at least one top through opening therein and includes at least one top latching member. The bottom housing portion of the retainer housing defines at least one bottom through opening therein and includes at least one bottom latching member engaging the at least one top latching member. The circuit board includes opposing major top and bottom surfaces, a front mating end disposed outside the retainer housing and configured to mate with a mating connector, and a rear cable end disposed inside the retainer housing, a plurality of conductive top and bottom front pads disposed on the respective top and bottom surfaces near the front mating end; and a plurality of conductive top and bottom rear pads disposed on the respective top and bottom surfaces near the rear cable end and electrically connected to the plurality of conductive top and bottom front pads. The plurality of conductors of the at least one substantially flat top cable includes uninsulated front ends terminated at the top rear pads in at least one top termination region, each top termination region aligned with and exposed through a corresponding top through opening in the at least one top through opening. The plurality of conductors of the at least one substantially flat bottom cable includes uninsulated front ends terminated at the bottom rear pads in at least one bottom termination region, each bottom termination region aligned with and exposed through a corresponding bottom through opening in the at least one bottom through opening. The adhesive at least partially fills each through opening in the at least one top and bottom through openings and bonds the uninsulated front ends of the conductors in the corresponding exposed termination region to the circuit board.

In some aspects of the present description, a retainer assembly is configured to house a circuit board and a cable terminated at the circuit board. The retainer assembly is configured to be inserted into a plug housing along an insertion direction, orthogonal to a thickness direction of the retainer assembly, to form a plug connector. The retainer assembly includes a first retainer and a second retainer. The first retainer includes a first base elongated along a length direction orthogonal to the insertion and thickness directions, and opposing first lateral sides extending from opposite edges of the first base along the thickness direction and orthogonal to the first base, where each first lateral side includes a first latching member and defining a cutout therein. The second retainer is assembled to the first retainer and includes a second base elongated along the length direction substantially parallel to the first base, and opposing second lateral sides extending from opposite edges of the second base along the thickness direction and orthogonal to the second base, where each second lateral side includes a second latching member and defining a protrusion. The second retainer is assembled to the first retainer by first partially inserting the protrusion of each second lateral side in the cutout of the corresponding first lateral side while the second base makes an oblique angle with the first base, and then rotating the second retainer substantially about an axis connecting the cutouts of the first lateral sides to reduce the oblique angle while at the same time further inserting the protrusions in the cutouts until the first and second latching members latch onto each other.

In some aspects of the present description, a plug housing assembly configured to receive a retainer assembly is provided, the retainer assembly including a circuit board and at least one cable terminated at the circuit board, along an insertion direction, orthogonal to a thickness direction of the plug housing assembly, to form a plug connector. The plug housing assembly includes a plug housing, and a latching member. The plug housing includes a rear opening for insertion of the retainer assembly, an opposing front opening, a middle wall separating the front opening from the rear opening, such that when the retainer assembly is inserted into the plug housing through the rear opening of the plug housing, rear and front portions of the circuit board of the retainer assembly are disposed in the respective rear and front openings of the plug housing, and a middle portion of the circuit board is disposed in an opening of the middle wall, and a top side of the housing including spaced apart front and rear walls defining a recess therebetween. The latching member is disposed in the recess, and includes a base disposed on a bottom wall of the recess between the front and rear walls, a first support arm, a latching arm, and a second support arm. The first support arm extends rearwardly from the base along the insertion direction toward the rear wall and includes an end portion disposed in an opening defined in the rear wall, and a joining portion joining base to the end portion, the end portion comprising a free end portion bent toward the bottom wall of the recess. The latching arm extends forwardly from the base along the insertion direction toward and past the front wall and comprising an end portion and terminates in a latch for latching onto a latching member of a mating connector of the plug connector, and a joining portion connecting the end portion to the base and disposed in an opening defined in the front wall. The second support arm is cut out from the base and bent away from the base toward the bottom wall of the recess, the second support arm including a bent portion in contact with the bottom wall of the recess.

DETAILED DESCRIPTION

Figure 1:
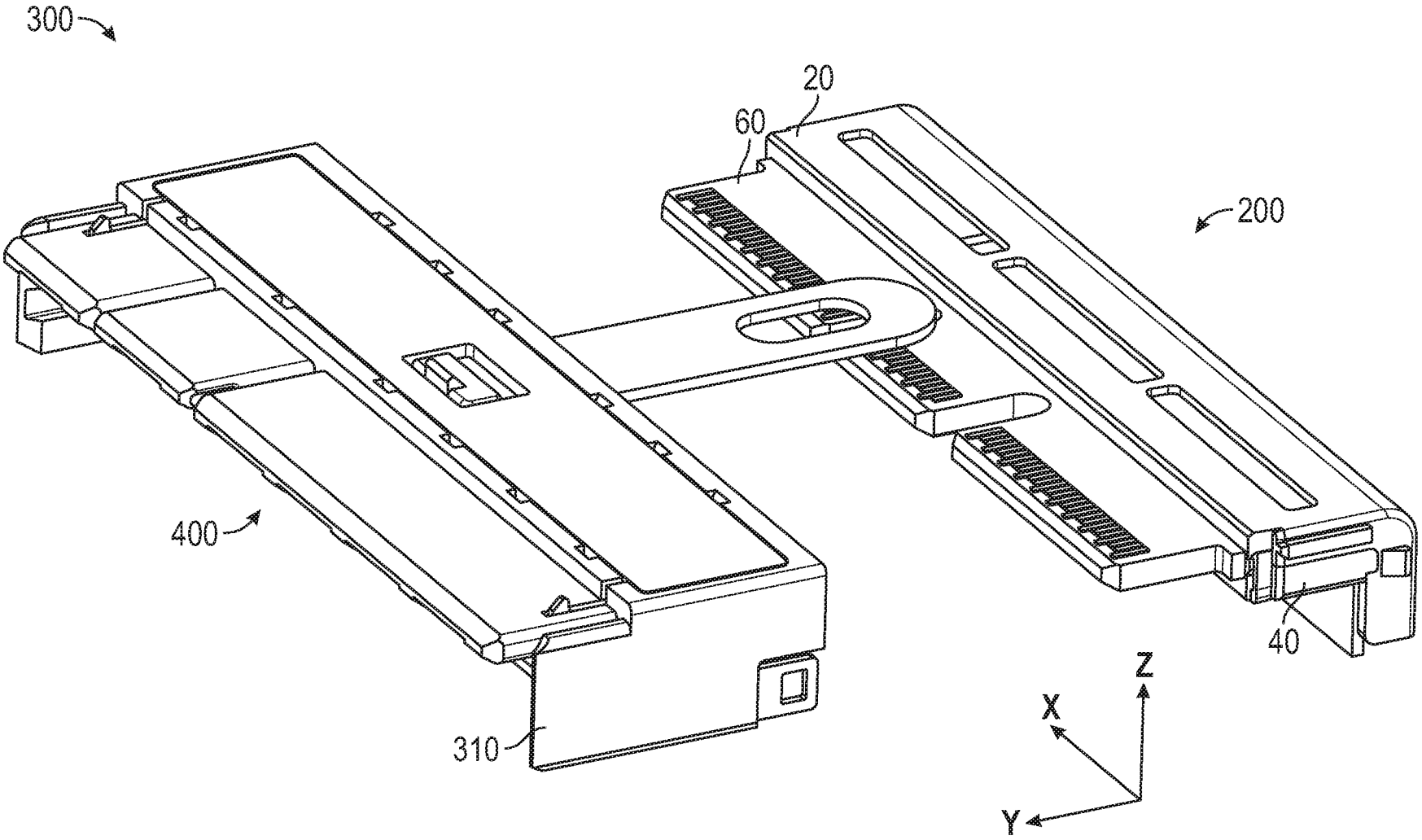
FIG. 1 is a perspective view of a plug connector, in accordance with an embodiment of the present description.

In the following description, reference is made to the accompanying drawings that form a part hereof and in which various embodiments are shown by way of illustration. The drawings are not necessarily to scale. It is to be understood that other embodiments are contemplated and may be made without departing from the scope or spirit of the present description. The following detailed description, therefore, is not to be taken in a limiting sense.

The data center industry has created several data center consortiums in recent years to offer standardized data products and to encourage data/computer sever suppliers to build servers with higher data rates. Common printed circuit board (PCB) materials available today do not perform well as the data rates continue to increase. As a result, special, high-performance materials are being developed, but these materials are costly. For some applications, a costly repeater/retimer component may be necessary when using common PCB materials to improve signal quality over long circuit traces, connectors, and cables. Twinaxial cables, or "Twinax", may be used to eliminate or minimize the need for costly PCB materials and repeater/retimers. The Gen-Z Consortium has set out to develop a high-volume universal connector, which has been adopted by several industry standards organizations (e.g., the Open Compute Project, the Gen-Z Consortium) to be the interconnect of choice to replace the PCB traces with cable assemblies to transmit the high-speed data.

According to some aspects of the present description, a high speed electrical cable assembly that mates with Gen-Z scalable connectors is described. In some embodiments, a retainer assembly configured to be inserted into a plug housing to form a plug connector is provided. In some embodiments, the retainer assembly includes a retainer housing including a top housing portion and a bottom housing portion, a printed circuit board (PCB) partially disposed between the top and bottom housing portions, at least one substantially flat top cable including a plurality of conductors, at least one substantially flat bottom cable including a plurality of conductors, and an adhesive for bonding the conductors to the circuit board. In some embodiments, the retainer assembly may be configured to define a straight cable exit option. In some embodiments, the retainer assembly may be configured to define a right-angle cable exit option.

In some embodiments, the top housing portion of the retainer housing defines at least one top "through" opening therein (i.e., an opening or hole through which portions of the PCB and/or conductors may be accessed) and includes at least one top latching member. In some embodiments, the bottom housing portion of the retainer housing defines at least one bottom through opening therein and includes at least one bottom latching member configured to engage the at least one top latching member.

The PCB includes opposing major top and bottom surfaces, a front mating end disposed outside the retainer housing and configured to mate with a mating connector, and a rear cable end disposed inside the retainer housing. In some embodiments, a plurality of conductive top and bottom front pads may be disposed on the respective top and bottom surfaces near the front mating end of the PCB, and a plurality of conductive top and bottom rear pads disposed on the respective top and bottom surfaces near the rear cable end and electrically connected to the plurality of conductive top and bottom front pads. In some embodiments, the plurality of conductors of the at least one substantially flat top cable may include uninsulated front ends terminated at the top rear pads in at least one top termination region, each top termination region aligned with and exposed through a corresponding top through opening in the at least one top through opening. Similarly, the plurality of conductors of the at least one substantially flat bottom cable may include uninsulated front ends terminated at the bottom rear pads in at least one bottom termination region, each bottom termination region aligned with and exposed through a corresponding bottom through opening in the at least one bottom through opening. In some embodiments, the adhesive at least partially fills each through opening in the at least one top and bottom through openings, and bonds the uninsulated front ends of the conductors in the corresponding exposed termination region to the PCB.

According to some aspects of the present description, a retainer assembly is configured to house a circuit board and a cable terminated at the circuit board. The retainer assembly is configured to be inserted into a plug housing along an insertion direction, orthogonal to a thickness direction of the retainer assembly, to form a plug connector. The retainer assembly includes a first retainer and a second retainer. The first retainer includes a first base elongated along a length direction orthogonal to the insertion and thickness directions, and opposing first lateral sides extending from opposite edges of the first base along the thickness direction and orthogonal to the first base, where each first lateral side includes a first latching member and defining a cutout therein. The second retainer is assembled to the first retainer and includes a second base elongated along the length direction substantially parallel to the first base, and opposing second lateral sides extending from opposite edges of the second base along the thickness direction and orthogonal to the second base, where each second lateral side includes a second latching member and defining a protrusion. The second retainer is assembled to the first retainer by first partially inserting the protrusion of each second lateral side in the cutout of the corresponding first lateral side while the second base makes an oblique angle with the first base, and then rotating the second retainer substantially about an axis connecting the cutouts of the first lateral sides to reduce the oblique angle while at the same time further inserting the protrusions in the cutouts until the first and second latching members latch onto each other. In some embodiments, the retainer assembly may be configured to define either a straight cable exit option or a right-angle cable exit option, depending on the configuration of at least one of the top housing portion or the bottom housing portion (i.e., at least one of the housing portions may be interchanged to switch configurations between a straight cable exit option and a right-angle cable exit option.)

In some aspects of the present description, a plug housing assembly configured to receive a retainer assembly is provided, the retainer assembly including a circuit board and at least one cable terminated at the circuit board, along an insertion direction, orthogonal to a thickness direction of the plug housing assembly, to form a plug connector. In some embodiments, the plug housing assembly includes a plug housing, and a latching member. In some embodiments, the plug housing includes a rear opening for insertion of the retainer assembly, an opposing front opening, a middle wall separating the front opening from the rear opening, and a top side of the housing including spaced apart front and rear walls defining a recess therebetween. In some embodiments, the plug housing may be configured such that, when the retainer assembly is inserted into the plug housing through the rear opening of the plug housing, rear and front portions of the circuit board of the retainer assembly are disposed in the respective rear and front openings of the plug housing, and a middle portion of the circuit board is disposed in an opening of the middle wall.

In some embodiments, the latching member may be disposed in the recess between the front and rear walls, and may include a base disposed on a bottom wall of the recess between the front and rear walls, a first support arm, a latching arm, and a second support arm. In some embodiments, the first support arm may extend rearwardly from the base along the insertion direction toward the rear wall and may include an end portion disposed in an opening defined in the rear wall, and a joining portion joining base to the end portion, the end portion comprising a free end portion bent toward the bottom wall of the recess.

In some embodiments, the latching arm may extend forwardly from the base along the insertion direction toward and past the front wall and comprising an end portion, and terminating in a latch for latching onto a latching member of a mating connector of the plug connector, and a joining portion connecting the end portion to the base and disposed in an opening defined in the front wall. In some embodiments, the second support arm is cut out from the base and bent away from the base toward the bottom wall of the recess, the second support arm including a bent portion in contact with the bottom wall of the recess.

Turning now to the figures, FIG. 1 is a perspective view of an embodiment of a plug connector. In some embodiments, a plug connector 300 includes a plug housing assembly 400 and a retainer assembly 200. The plug housing assembly includes a plug housing 310, which is discussed in greater detail elsewhere herein. In some embodiments, the retainer assembly 200 may include a printed circuit board (PCB) 60, a top housing portion 20, and a bottom housing portion 40. In some embodiments, top housing portion 20 may be configured to create a right-angle cable exit (as shown in the embodiment of FIG. 1), while in other embodiments, top housing portion 20 may be configured to create a straight cable exit (e.g., the embodiment shown in FIG. 2). In some embodiments, plug housing 310 may define a rear opening (not shown in FIG. 1) for insertion of the retainer assembly 200 when fully assembled. Additional detail on the assembly of plug connector 300 is provided herein.

Figure 2:
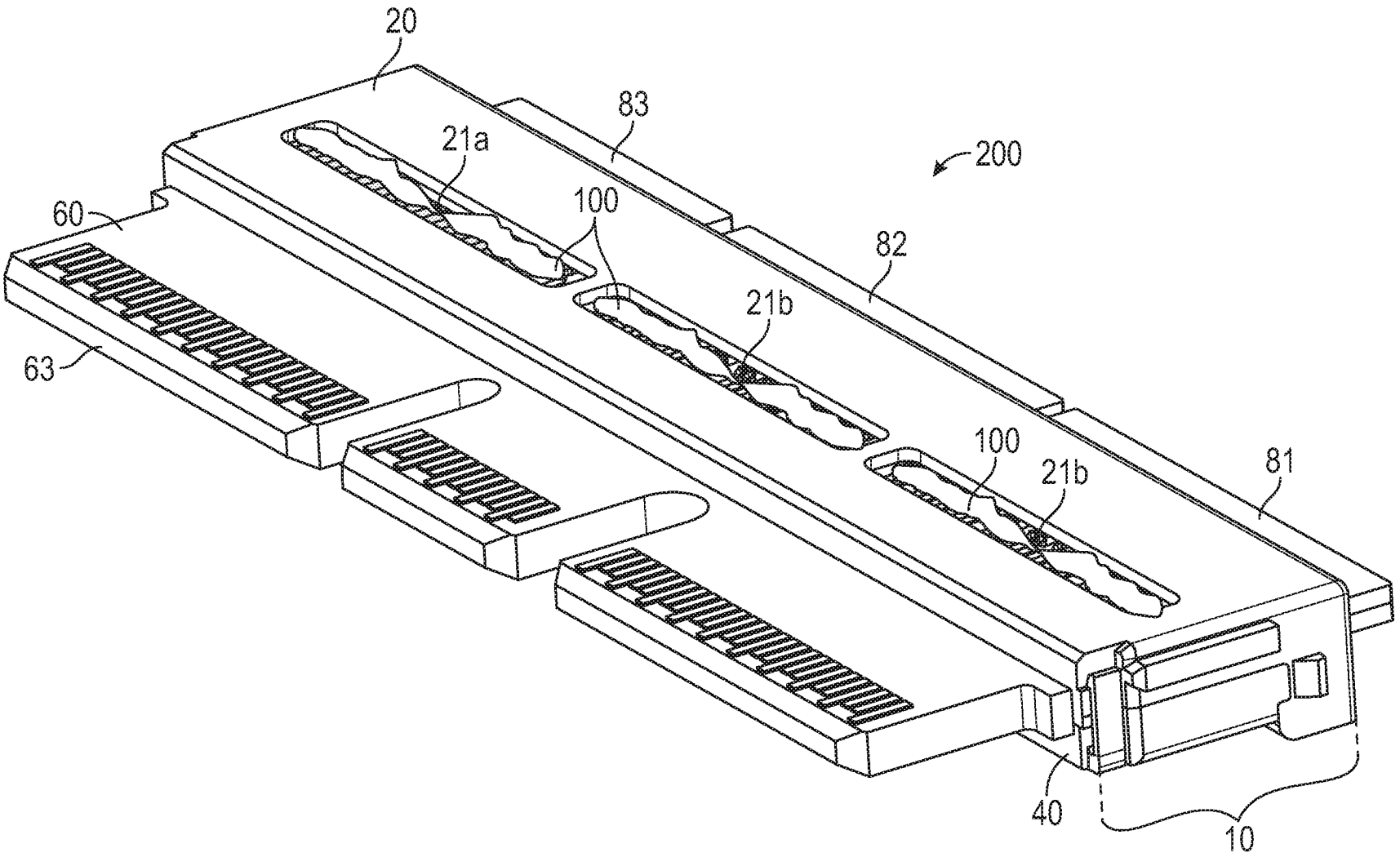
FIG. 2 is a perspective top view of a retainer assembly, in accordance with an embodiment of the present description.

FIG. 2 is a perspective top view of an embodiment of a retainer assembly 200 including a retainer housing 10, a PCB 60, and at least one substantially flat cable (e.g., substantially flat top cables 81, 82, and 83). In some embodiments, retainer housing 10 includes a top housing portion 20, and a bottom housing portion 40. In some embodiments, PCB 60 may be partially disposed between top housing portion 20 and bottom housing portion 40. In some embodiments, a front mating end 63 of PCB 60 may extend outside of retainer housing 10. In some embodiments, the top housing portion 20 may define one or more top through openings 21 (including, in the embodiment shown in FIG. 2, through openings 21*a*, 21*b*, and 21*c*). In some embodiments, conductors from one or more substantially flat cables (including substantially flat top cables 81, 82, and 83 shown in FIG. 2) are bonded to the PCB 60 in one or more termination regions (not shown) accessible via through openings 21*a*, 21*b*, and 21*c*. In some embodiments, bottom housing portion 40 may have additional through openings, as will be detailed in additional drawings herein. In some embodiments, an adhesive 100 at least partially fills each through opening 21*a*, 21*b*, and 21*c* (and additional through openings in bottom housing 40, if applicable, not shown in FIG. 2) and bonds the conductors to the corresponding termination region on PCB 60.

In the embodiment of FIG. 2, top housing portion 20 is configured to create a straight cable exit (i.e., does not contain a right-angle bend), as opposed to the embodiment of top housing portion 20 as shown in FIG. 1. That is, the substantially flat cables (e.g., substantially flat top cables 81, 82, and 83) extend out from retainer housing 10 in a direction substantially parallel with the plane defined by PCB 60.

Figure 3:
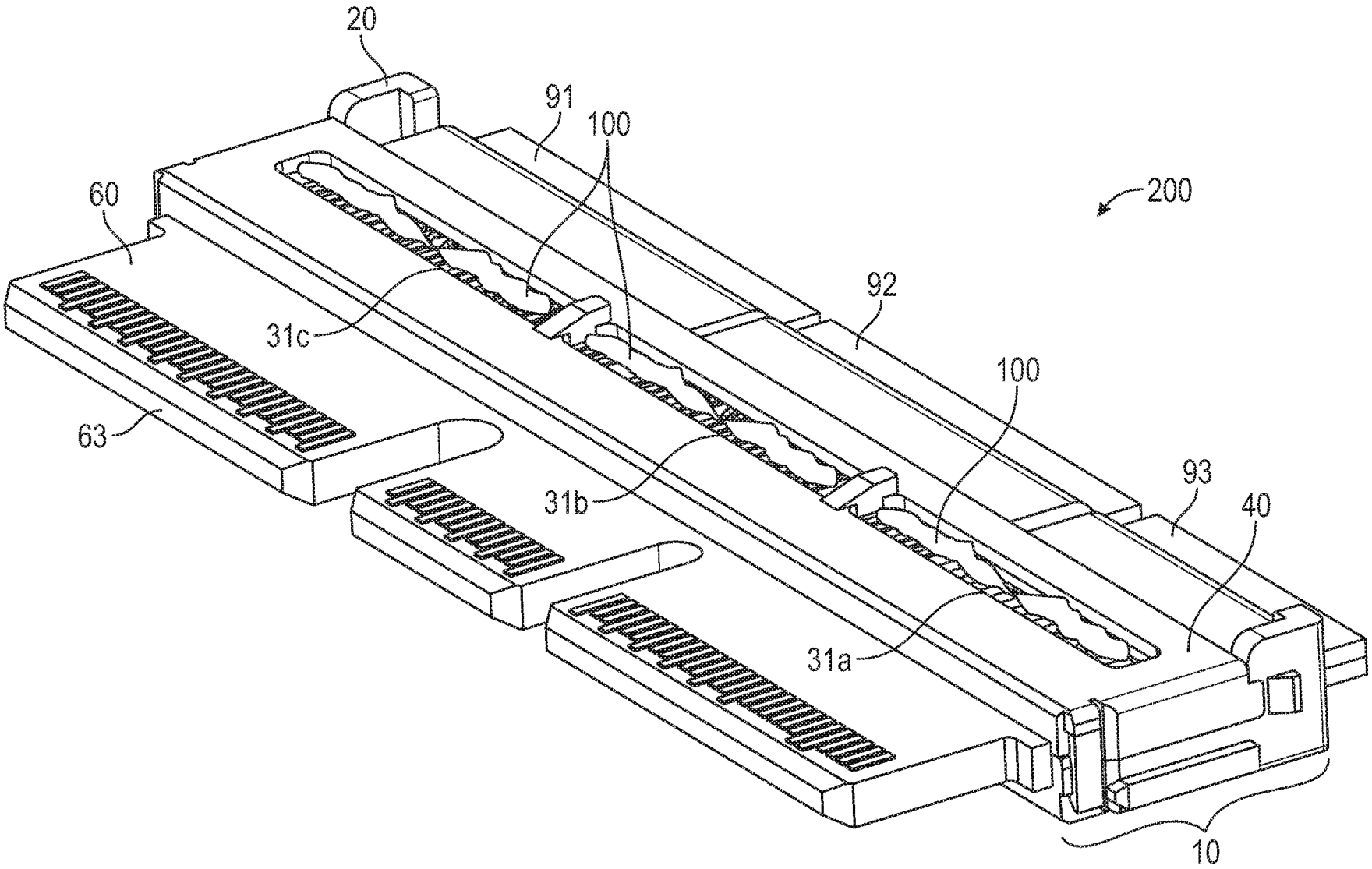
FIG. 3 is a perspective bottom view of a retainer assembly, in accordance with an embodiment of the present description.

FIG. 3 is a perspective bottom view of the embodiment of the retainer assembly 200 of FIG. 2. In some embodiments, the bottom housing portion 40 may define one or more bottom through openings 31 (including, in the embodiment shown in FIG. 3, through openings 31*a*, 31*b*, and 31*c*). In some embodiments, conductors from one or more substantially flat cables (including substantially flat bottom cables 91, 92, and 93 shown in FIG. 3) are bonded to the PCB 60 in one or more termination regions (not shown) accessible via through openings 31*a*, 31*b*, and 31*c*. In some embodiments, an adhesive 100 at least partially fills each through opening 31*a*, 31*b*, and 31*c*, bonding the conductors to the corresponding termination region on PCB 60.

Figure 4A:
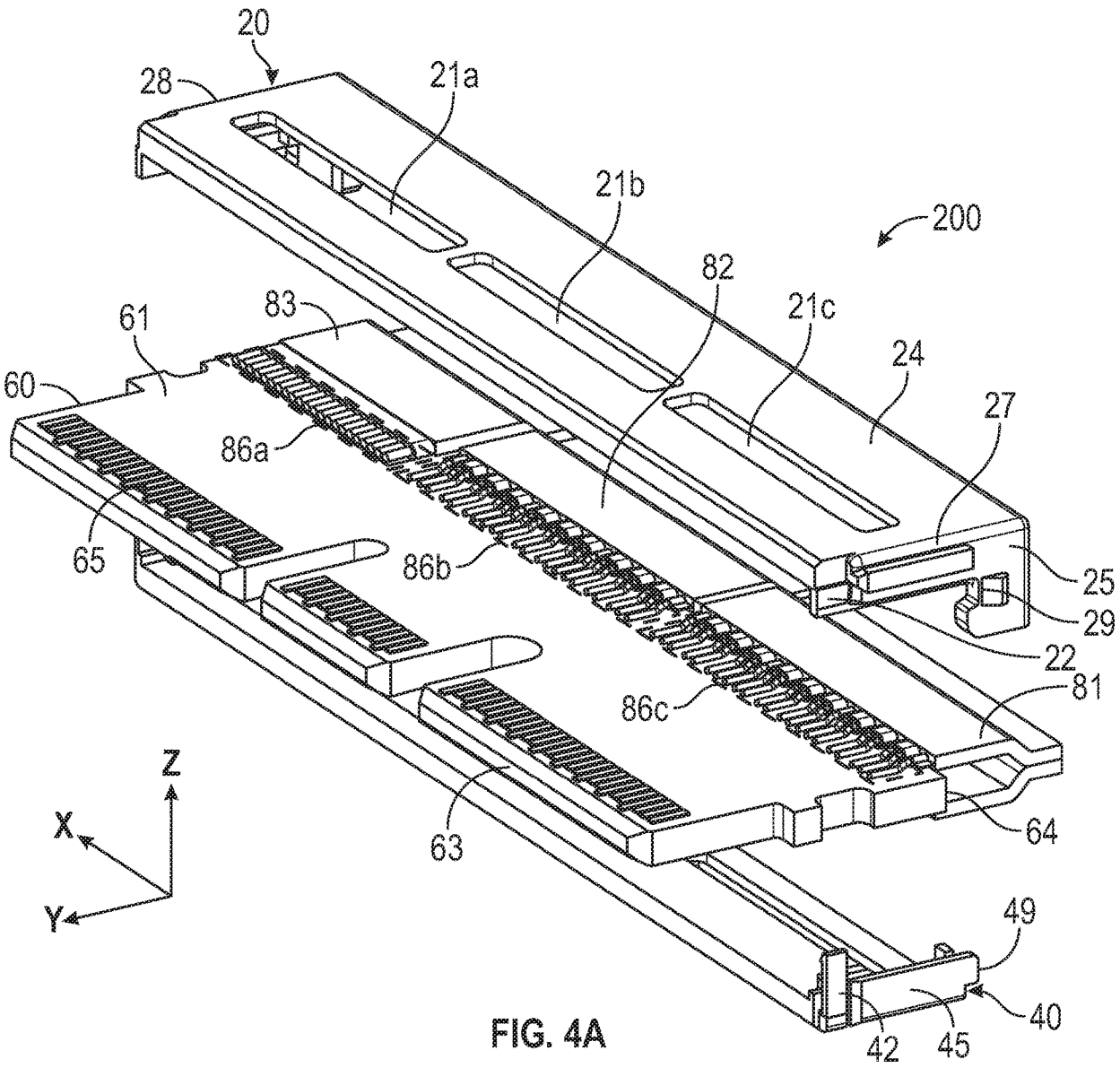
FIGS. 4A-4B are perspective exploded views of a retainer assembly, in accordance with an embodiment of the present description.
Figure 4B:
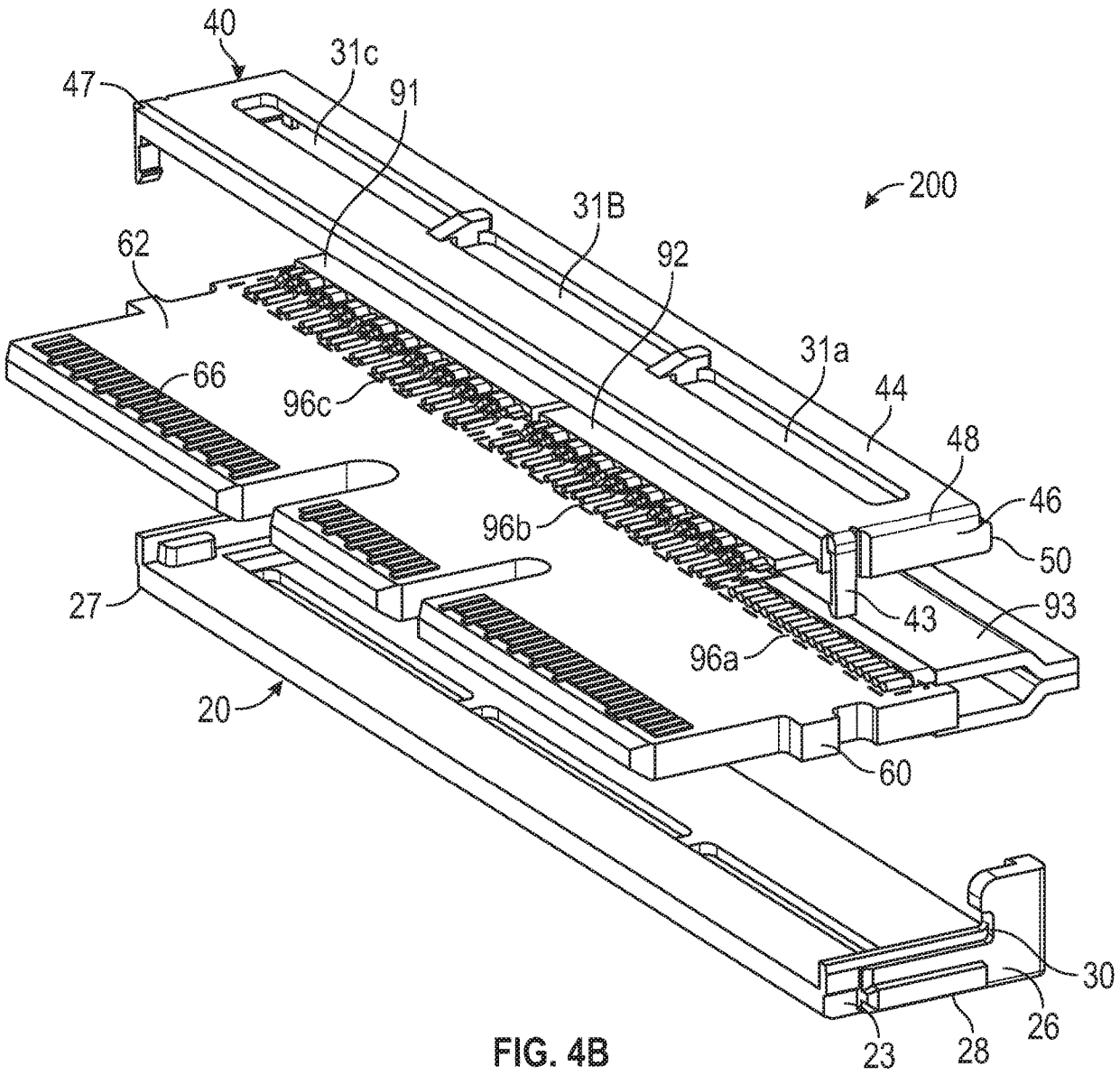

FIGS. 4A-4B are perspective exploded views of the embodiment of the retainer assembly 200 of FIGS. 2-3. FIG. 4A provides a top exploded view of retainer assembly 200, and FIG. 4B provides a bottom exploded view of retainer assembly 200. Elements common to both FIGS. 4A and 4B have like reference numbers. Referring now to both FIGS. 4A and 4B simultaneously, in some embodiments, retainer assembly 200 includes a retainer housing (including top housing portion 20 and bottom housing portion 40), a PCB 60, at least one substantially flat top cable (e.g., substantially flat top cables 81, 82, and 83), and at least one substantially flat bottom cable (e.g., substantially flat bottom cables 93, 92, and 91). PCB 60 includes a front mating end 63, a major top surface 61, and an opposing major bottom surface 62. In some embodiments, the major top surface 61 defines at least one top termination region (e.g., top termination regions 86*a*, 86*b*, and 86*c*), and the major bottom surface 62 defines at least one bottom termination region (e.g., bottom termination regions 96*c*, 96*b*, and 96*a*). Each of substantially flat top cables 81, 82, and 83 include a plurality of conductors which are terminated in corresponding top termination regions 86*a*, 86*b*, and 86*c*. Each of substantially flat top cables 93, 92, and 91 include a plurality of conductors which are terminated in corresponding top termination regions 96*c*, 96*b*, and 96*a*. In some embodiments, top termination regions 86*a*, 86*b*, and 86*c* may be accessible through top through openings 21*a*, 21*b*, and 21*c* in the top housing portion 20 of the retainer housing. In some embodiments, bottom termination regions 96*c*, 96*b*, and 96*a* may be accessible through top through openings 31*c*, 31*b*, and 31*a* in bottom housing portion 40 of the retainer housing.

The PCB 60 includes a front mating end 63 which may be disposed outside of the retainer housing and configured to mate with a mating connector, and a rear cable end 64 which may be disposed inside the retainer housing. In some embodiments, a top major surface 61 of the PCB 60 may define a plurality of conductive top front pads 65 near front mating end 63. In some embodiments, a bottom major surface 62 of the PCB 60 may define a plurality of conductive bottom front pads 66 near front mating end 63.

In some embodiments, top housing portion 20 (i.e., first retainer 20) which includes a first base 24 elongated along a length direction X orthogonal to an insertion direction Y and a thickness direction Z, and opposing first lateral sides 25 and 26 extending from opposite edges 27 and 28 of the first base 24 along a thickness direction Z and orthogonal to first base 24. Each first lateral side 25 and 26 includes a first latching member 22 and 23, respectively, and defining cutouts 29 and 30 respectively.

In some embodiments, bottom housing portion 40 (i.e., second retainer 40) which includes a second base 44 elongated along length direction substantially parallel to first base 24, and opposing second lateral sides 45 and 46 extending from opposite edges 47 and 48 of the second base 44 along the thickness direction Z and orthogonal to second base 44. Each second lateral side 45 and 46 includes a second latching member 42 and 43, respectively, and defining protrusions 49 and 50 respectively.

Figure 5A:
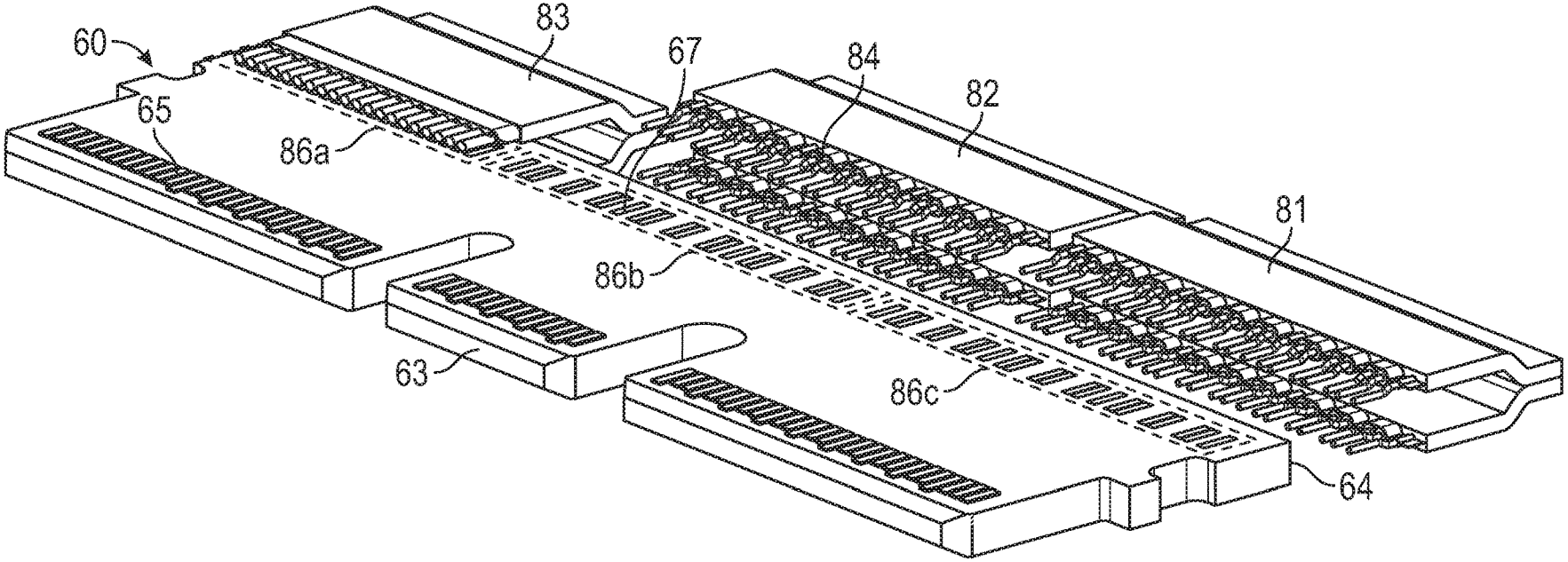
FIGS. 5A-5B are perspective views of a circuit board assembly, in accordance with an embodiment of the present description.
Figure 5B:
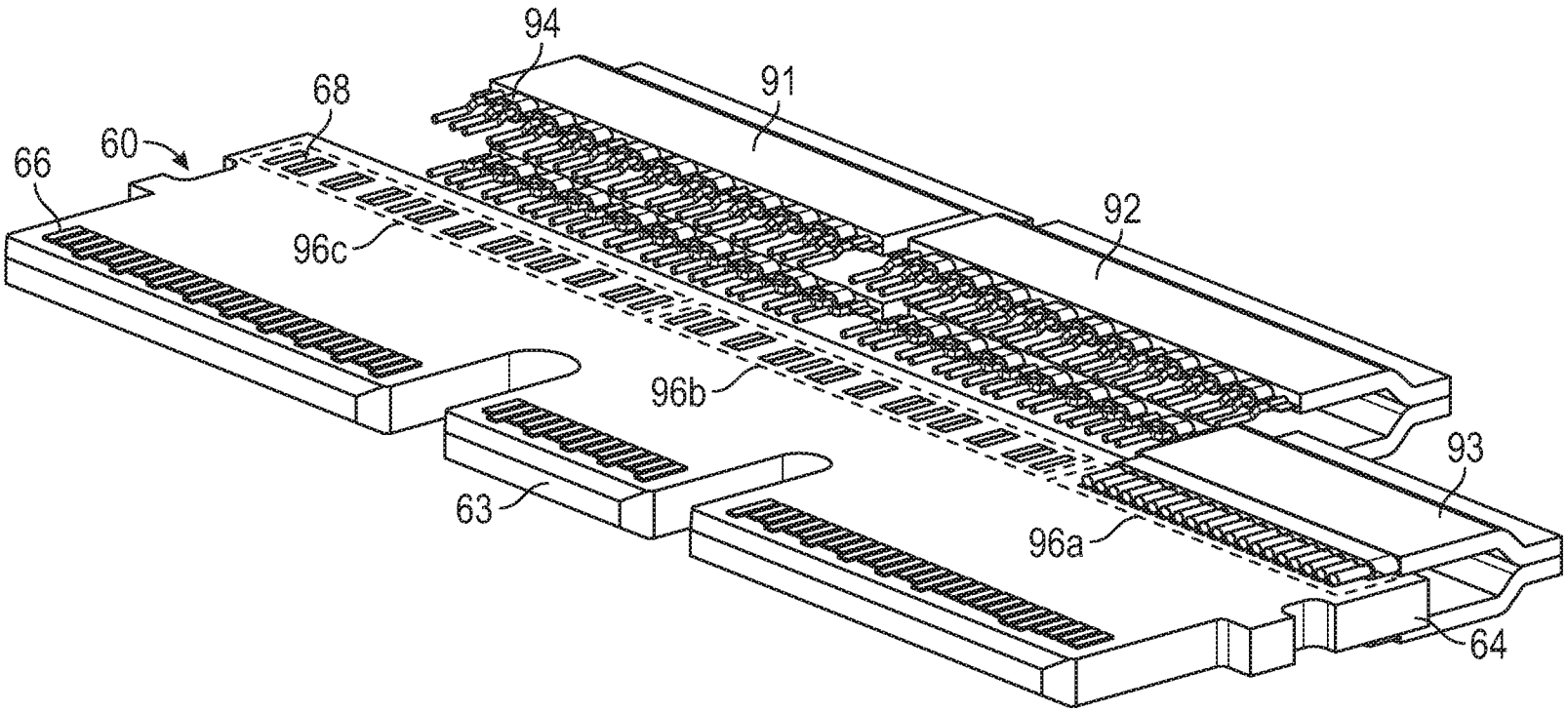
Figure 6A:
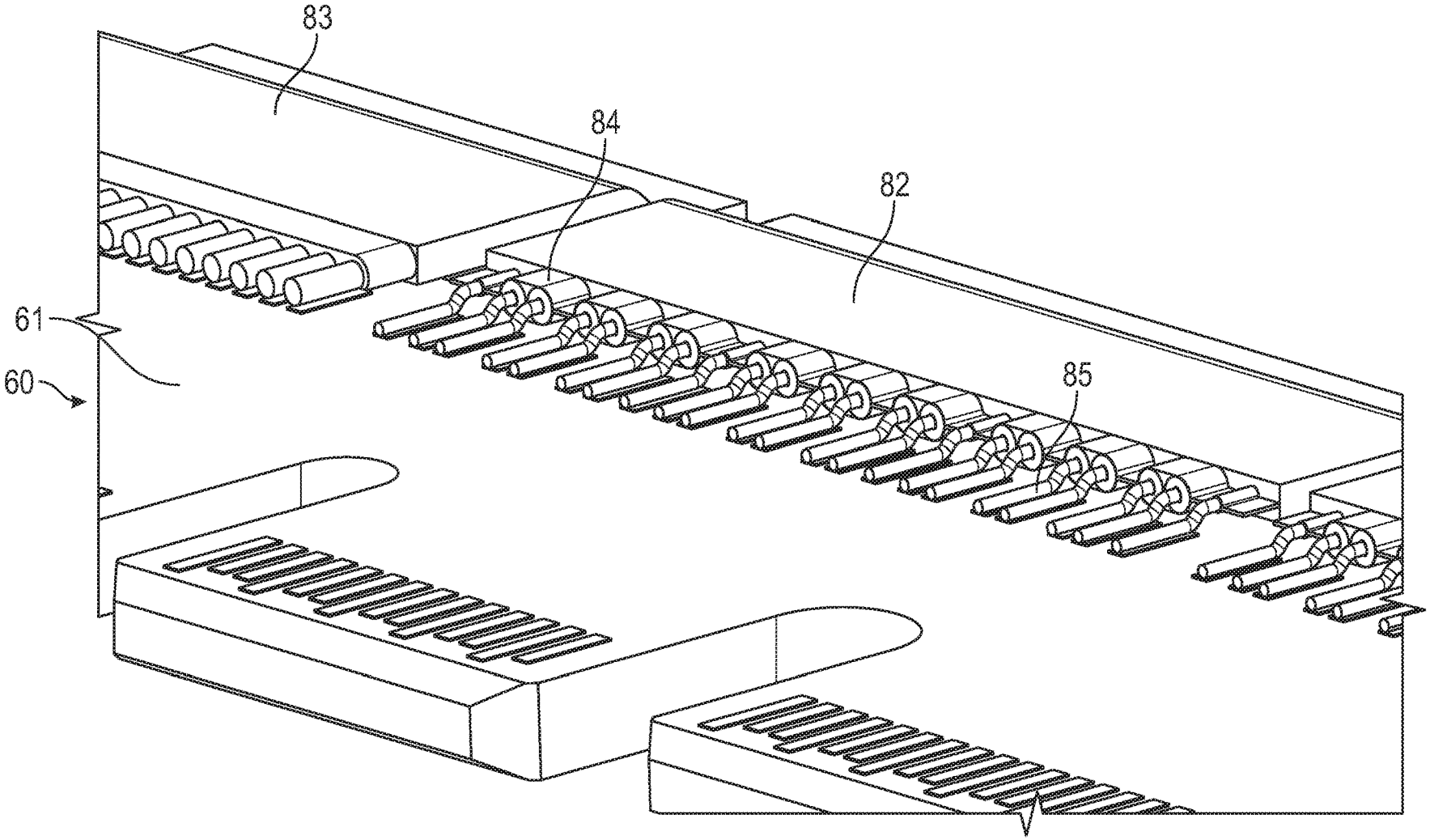
FIGS. 6A-6B are detailed perspective views of a circuit board assembly, in accordance with an embodiment of the present description.
Figure 6B:
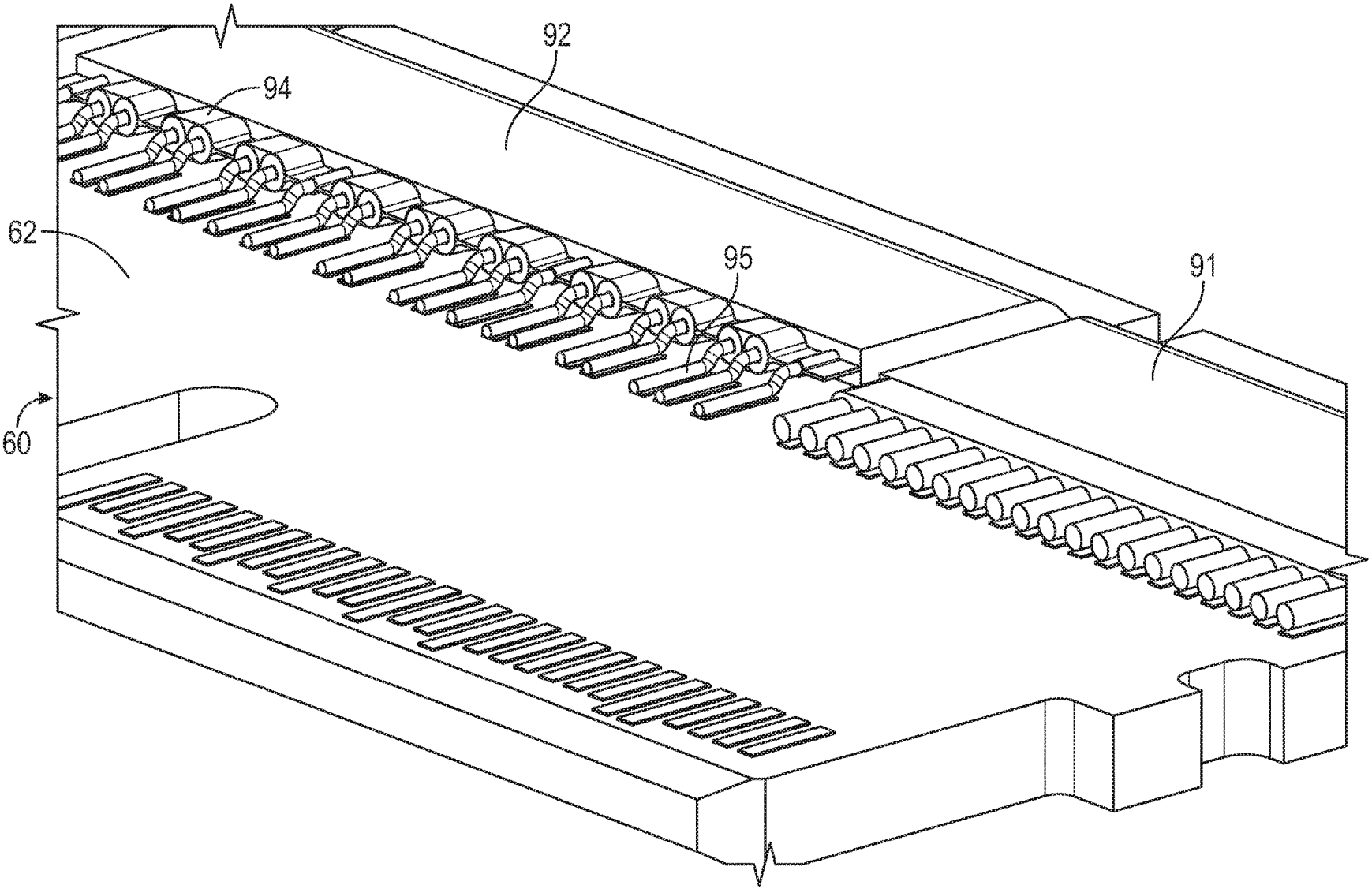

FIGS. 5A-5B and FIGS. 6A-6B provide various perspective views of a circuit board assembly, showing additional detail on connections between the circuit board and the substantially flat cables. Elements common to FIGS. 5A-5B and 6A-6B have like reference numbers, and the figures should be examined simultaneously for the following discussion. FIGS. 5A and 6A provide top perspective views, and FIGS. 5B and 6B provide bottom perspective views.

In some embodiments, circuit board 60 includes a major top surface 61, a major bottom surface 62, a front mating end 63, a rear cable end 64, a plurality of conductive top front pads 65, a plurality of conductive bottom front pads 66, a plurality of conductive top rear pads 67, and a plurality of conductive bottom rear pads 68. At least one substantially flat top cable (e.g., substantially flat top cables 81, 82, and 83 as shown in FIGS. 5A and 6A) includes a plurality of top conductors 84 and uninsulated front ends 85. Uninsulated front ends 85 are each terminated at one of the conductive top rear pads 67 in one of a top termination region (e.g., top termination regions 86*a*, 86*b*, and 86*c*). At least one substantially flat bottom cable (e.g., substantially flat bottom cables 93, 92, and 91 as shown in FIGS. 5B and 6B) includes a plurality of bottom conductors 94 and uninsulated front ends 95. Uninsulated front ends 85 are each terminated at one of the conductive top rear pads 68 in one of a bottom termination region (e.g., bottom termination regions 96*c*, 96*b*, and 96*a*).

Figure 7A:
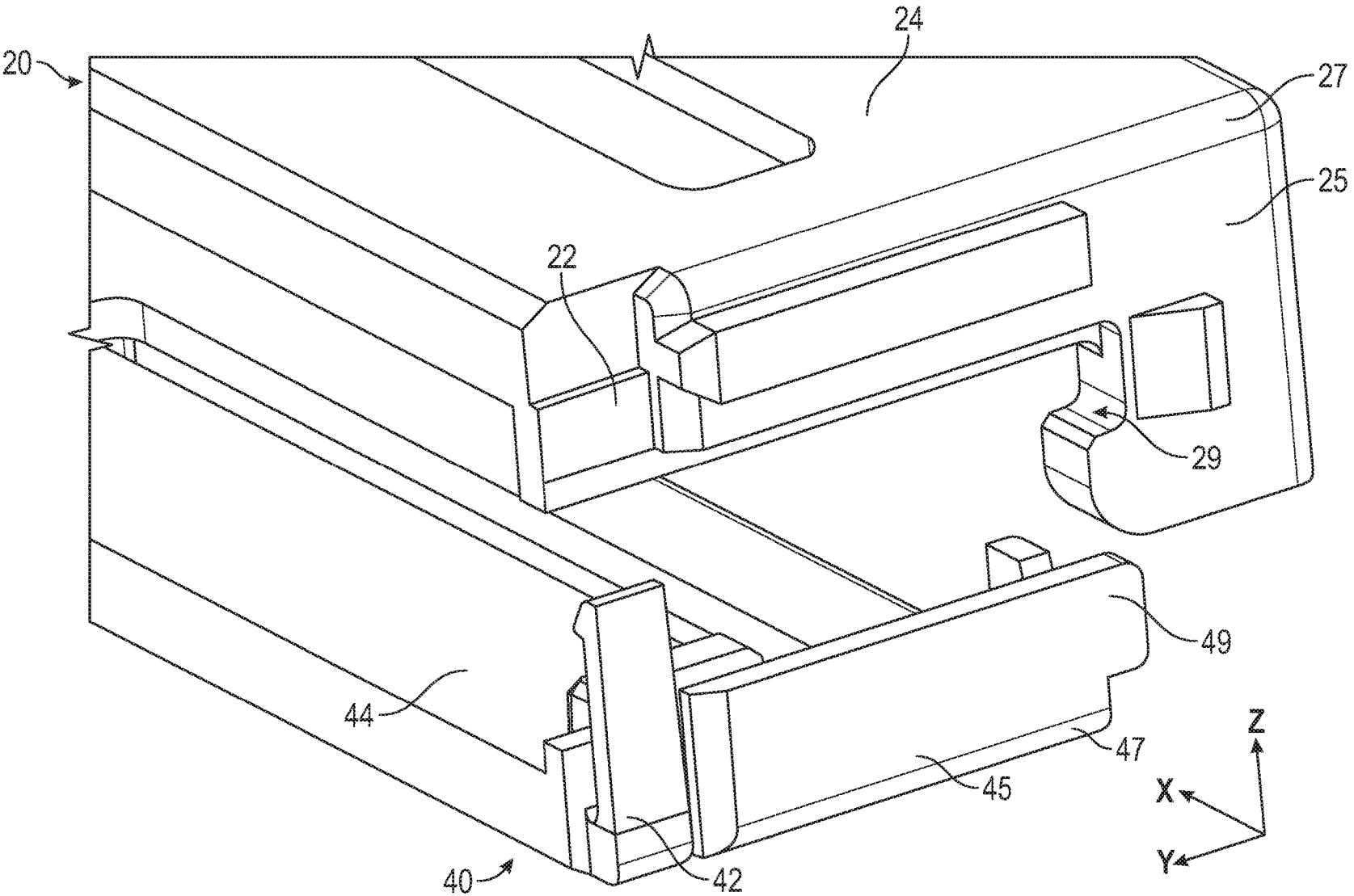
FIGS. 7A-7B are perspective views of the components of a retainer assembly, in accordance with an embodiment of the present description.
Figure 7B:
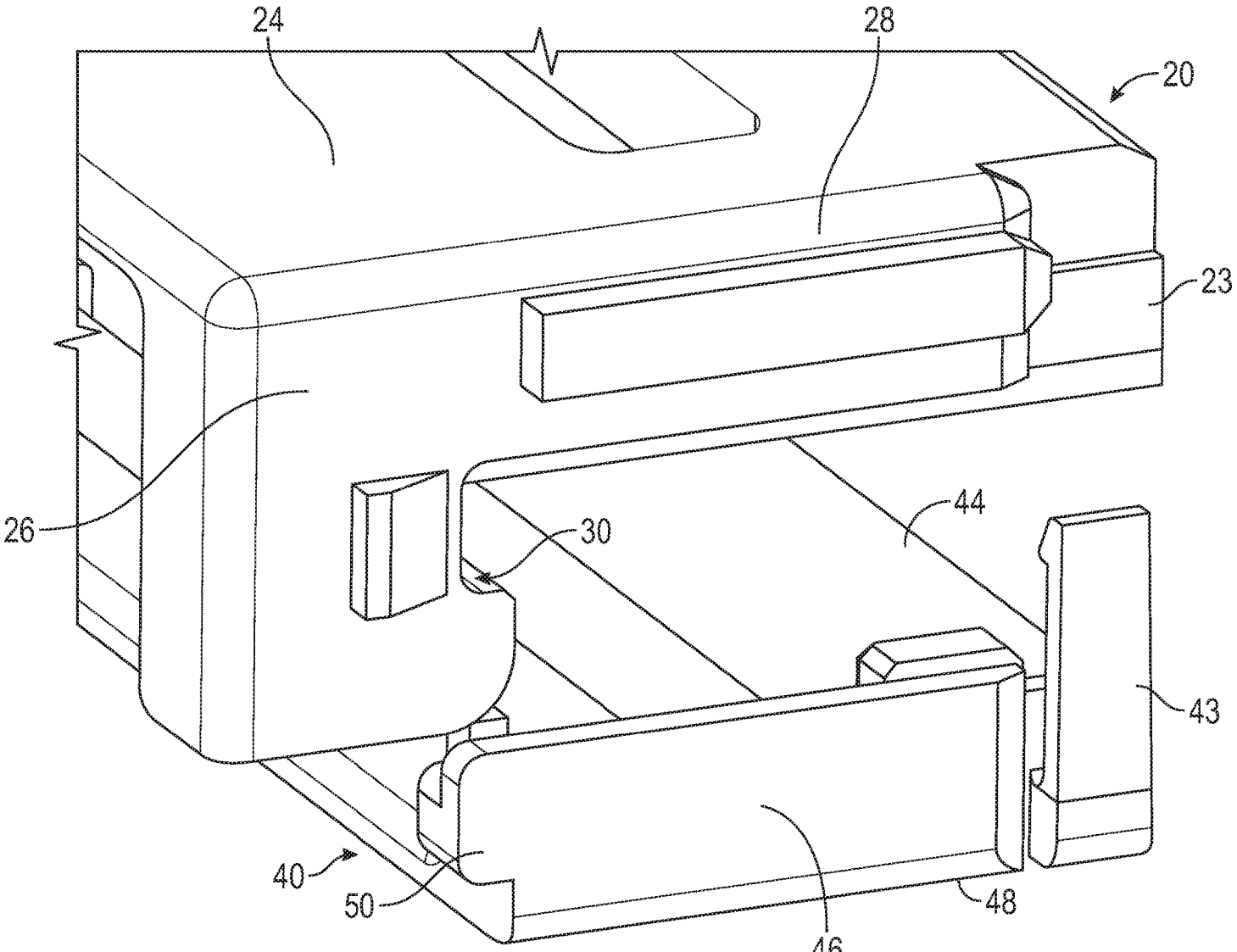
Figure 8A:
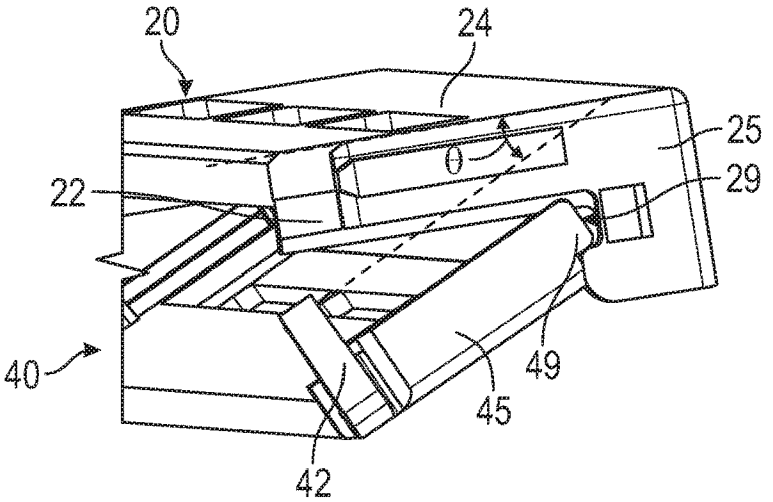
FIGS. 8A-8D illustrate the assembly of a retainer assembly, in accordance with an embodiment of the present description.
Figure 8B:
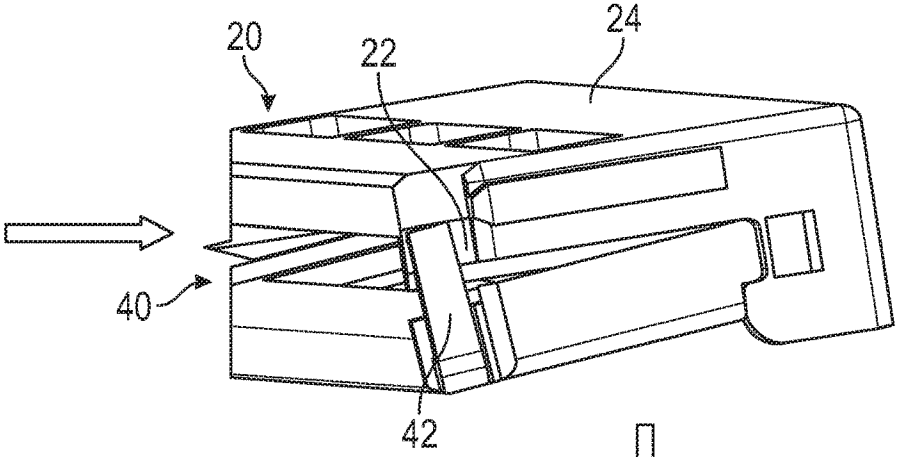
Figure 8C:
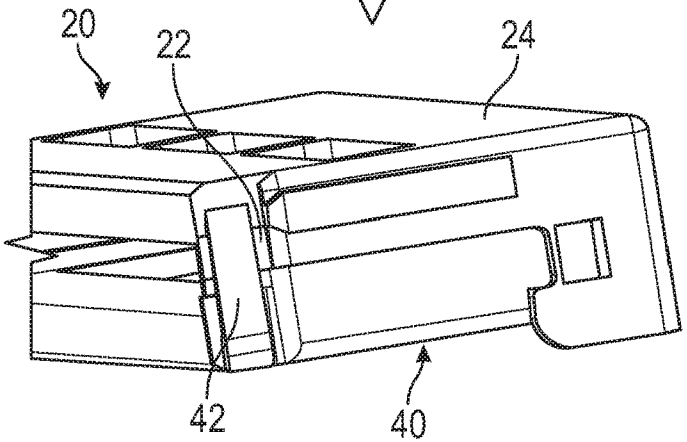
Figure 8D:
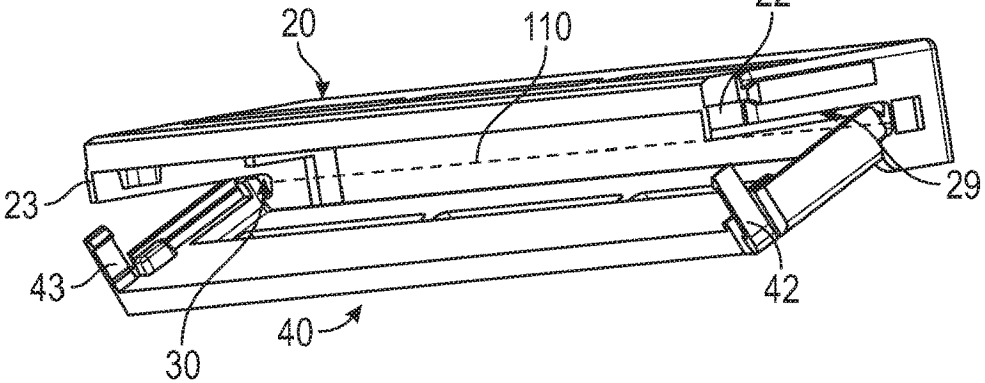

FIGS. 7A-7B provide additional details for the components of a retainer assembly, in accordance with an embodiment of the present description. Elements common to both FIGS. 7A and 7B have like reference numbers, and the figures should be examined simultaneously for the following discussion. Please note that PCB 60 and other components shown in previous figures are omitted here for simplicity and to focus on the features of the first and second housing portions (retainers) of the retainer assembly. The retainer assembly includes a top housing portion (or first retainer) 20 and a bottom housing portion (or second retainer) 40, wherein the second retainer 40 is assembled to the first retainer 20 to create a retainer assembly configured to house a circuit board (not shown in FIGS. 7A-7B).

In some embodiments, the first retainer 20 includes a first base 24 elongated along a length direction X orthogonal to an insertion direction Y and a thickness direction Z, and opposing first lateral sides 25 and 26 extending from opposite edges 27 and 28 of the first base along the thickness direction Z and orthogonal to the first base, each first lateral side 25 and 26 includes first latching members 22 and 23, respectively, and defining cutouts 29 and 30, respectively, therein. In some embodiments, the second retainer 40 is assembled to the first retainer 20 and includes a second base 44 elongated along the length direction X substantially parallel to the first base 24, and opposing second lateral sides 45 and 46, extending from opposite edges 47 and 48, respectively, of the second base 44 along the thickness direction Z and orthogonal to the second base 44, each second lateral side 45 and 46 including second latching members 42 and 43, respectively, and defining protrusions 49 and 50, respectively.

FIGS. 8A-8D illustrate the assembly of the embodiment of the retainer assembly of FIGS. 7A and 7B. FIGS. 7A, 7B, and 8A, 8B, 8C, and 8D should be examined simultaneously for the following discussion. In some embodiments, the second retainer 40 is assembled to the first retainer 20 by first partially inserting protrusions 49 and 50 of second lateral sides 45 and 46 in corresponding cutouts 29 and 30 of first lateral sides 25 and 26 while the second base makes an oblique angle θ with the first base 24 (FIG. 8A), and then rotating the second retainer 40 substantially about an axis 110 connecting cutouts 29 and 30 of first lateral sides 25 and 26 to reduce the oblique angle (FIG. 8D), while at the same time further inserting the protrusions 49 and 50 into cutouts 29 and 30 until the first latching members 22 and 23 latch onto second latching members 42 and 43. (See FIG. 8B, 8C, 8D).

Figure 9B:
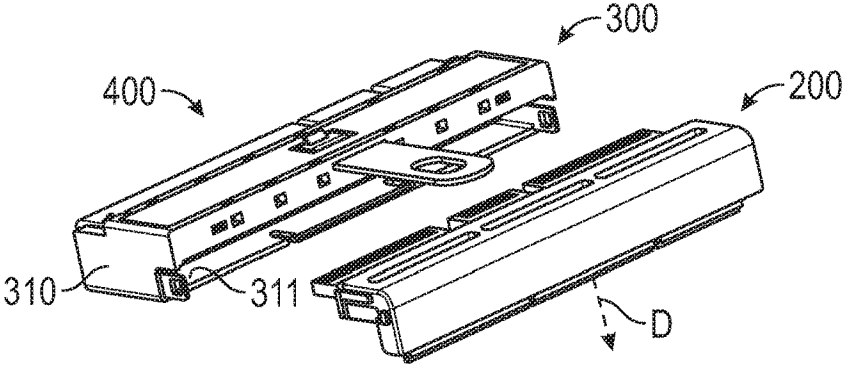
FIGS. 9A-9D provide various perspective views of the components of a plug connector, in accordance with an embodiment of the present description.
Figure 9D:
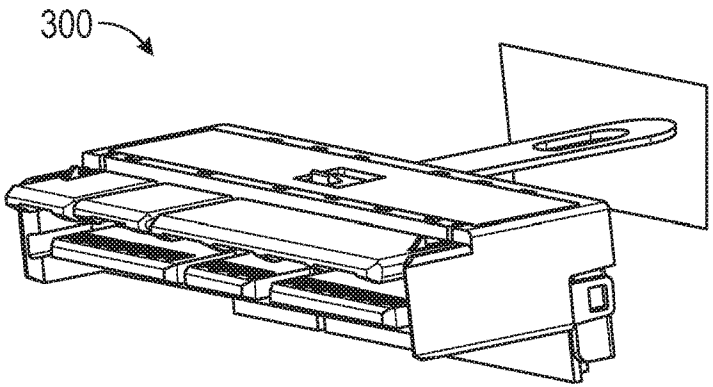
Figure 9A:
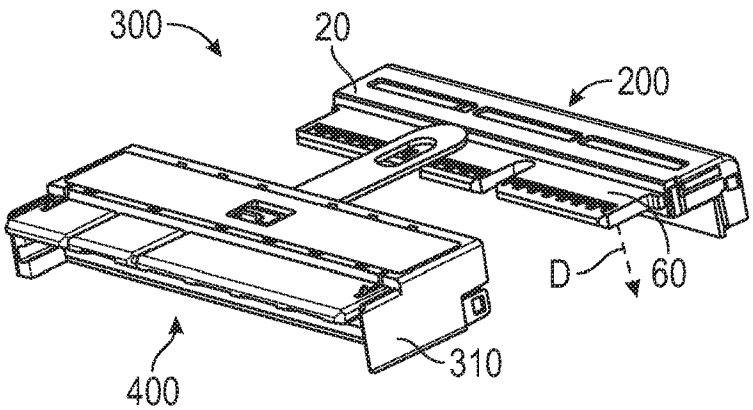

FIGS. 9A-9D provide various perspective views of the components of a plug connector including a right-angle cable exit, in accordance with an embodiment of the present description. Referring to FIG. 9A, a plug connector 300 includes major components plug housing assembly 400 including plug housing 310, and retainer assembly 200 including top housing portion 20. In some embodiments, top housing portion 20 may be configured to provide a right-angle cable exit (i.e., cables attached to PCB 60, not shown, exit top housing portion 20 in direction D, orthogonal to the plane of PCB 60.)

Figure 9C:
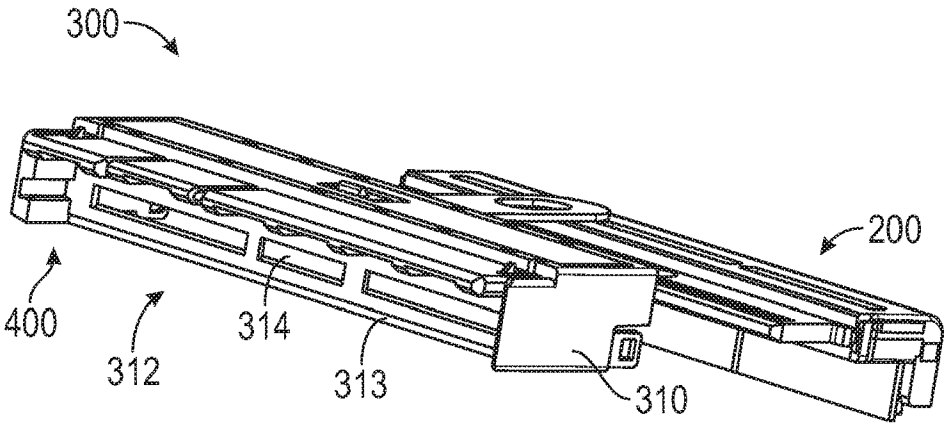

FIG. 9B shows plug connector 300 from a different angle, showing rear opening 311 in plug housing 310, through which retainer assembly 200 may be inserted. FIG. 9C shows yet another angle of plug connector 300, rotated such that front opening 312 in housing connector is visible. In some embodiments, a front edge of PCB 60 may be inserted into front opening 312 through opening 314 in middle wall 313, such that it can be in contact with a mating connector (not shown). Finally, FIG. 9D shows plug connector 300 in its fully assembled form.

Figure 10:
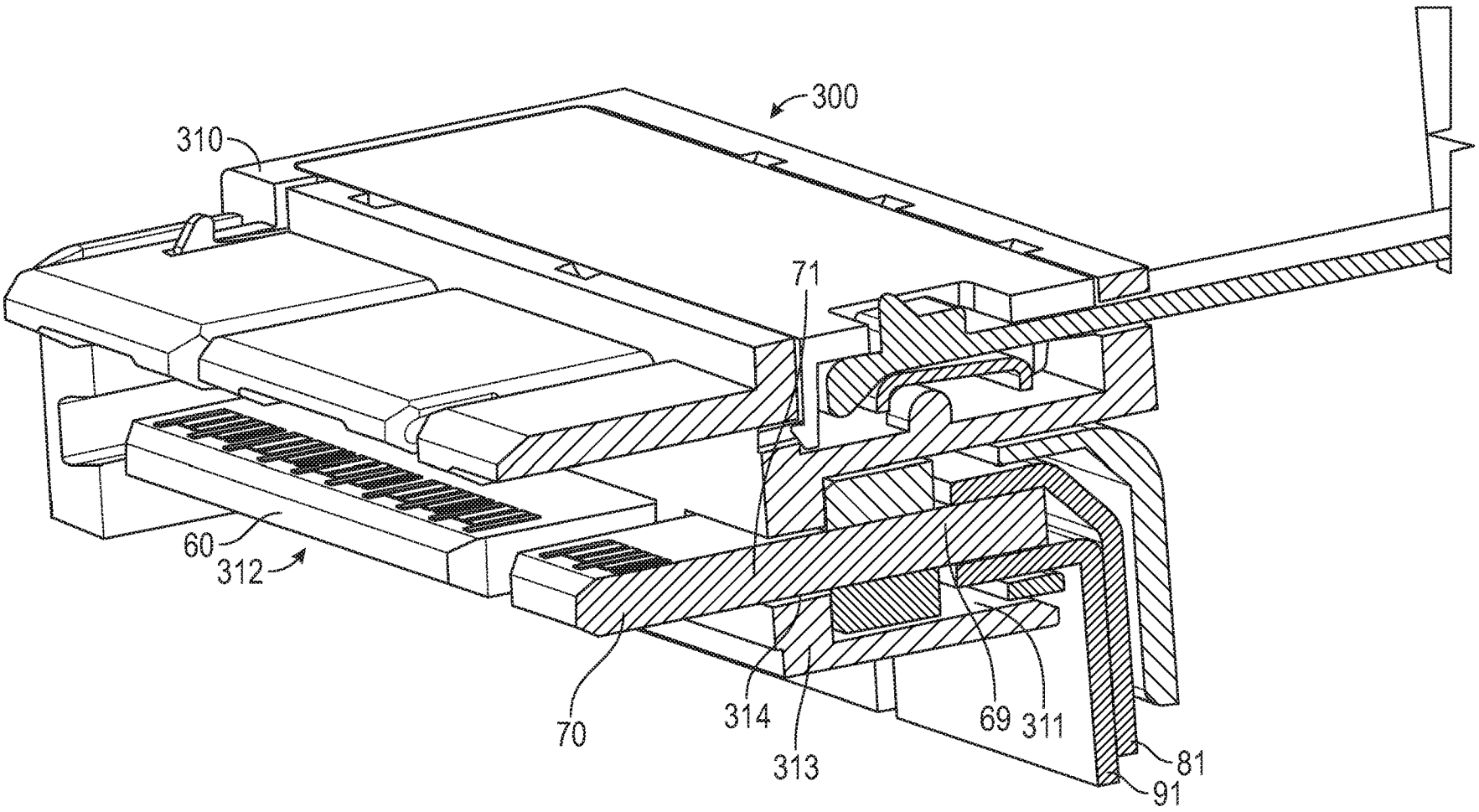
FIG. 10 is a cutaway, perspective view of the components of a plug connector, in accordance with an embodiment of the present description.

FIG. 10 is a cutaway, perspective view of the components of assembled plug connector 300 of FIGS. 9A-9D. PCB 60 is connected to at least one substantially flat top cable 81 and at least one substantially flat bottom cable 91 at rear portion 69 of PCB 60, located in rear opening 311 of plug housing 310. Middle portion 71 of PCB 60 is disposed in opening 314 in middle wall 313, and front portion 70 of PCB 60 extends out into front opening 312.

FIGS. 11A-14B provide perspective views of the components of a latching member inserted in plug housing 310 for the purpose of latching onto a mating connector. FIG. 15 is a perspective view of plug connector mating with (and latching to) a mating connector, in accordance with an embodiment of the present description. Elements common among FIGS. 11A through 15 have like reference numbers, and FIGS. 11A through 15 should be examined simultaneously for the following discussion.

Figure 11A:
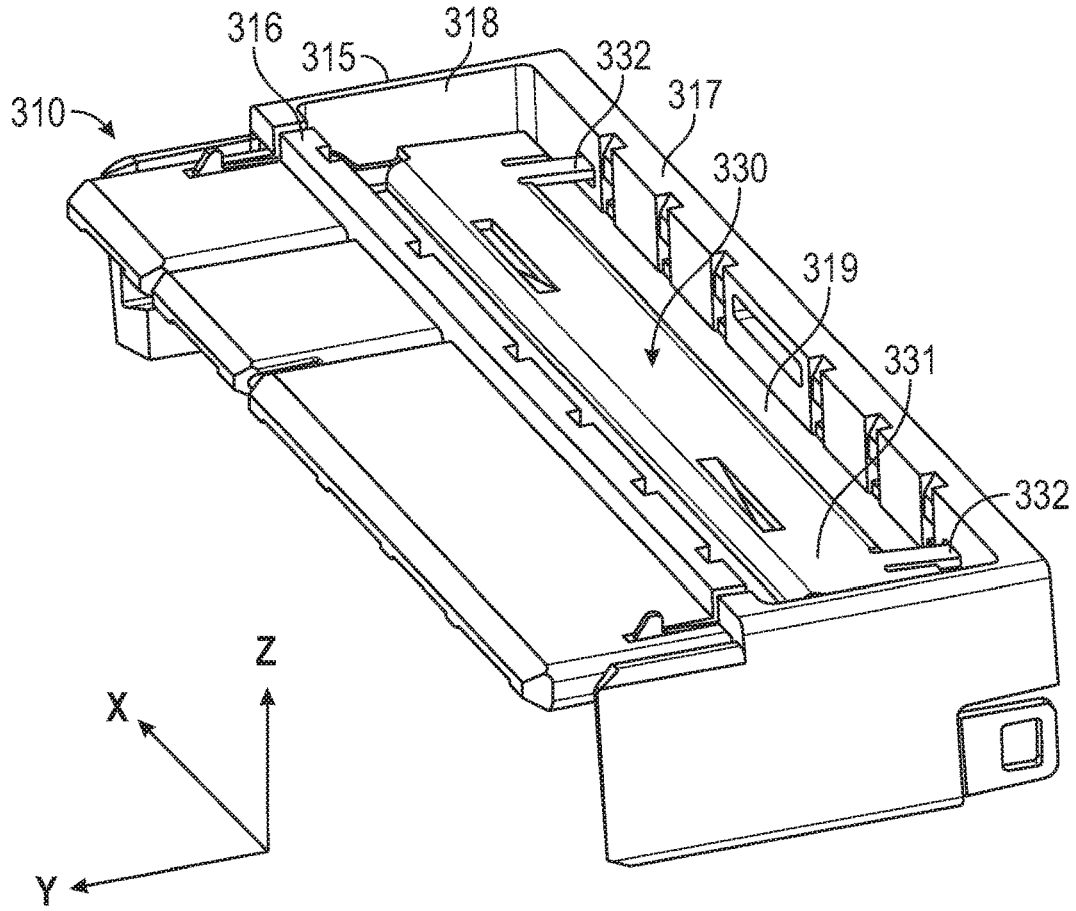
FIGS. 11A-11B are perspective views of the components of a latching member, in accordance with an embodiment of the present description.
Figure 11B:
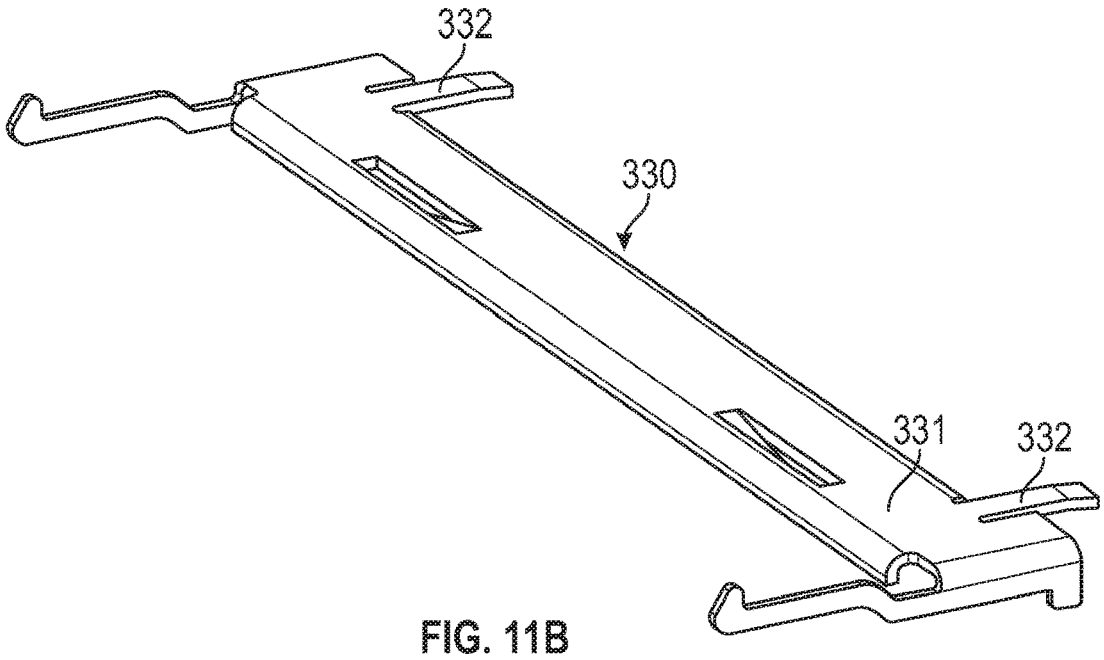

Turning to FIGS. 11A and 11B, these figures show latching member 330 by itself and installed in plug housing 310. Plug housing 310 includes top side 315, and top side 315 includes spaced apart front wall 316 and rear wall 317, defining recess 318 therebetween. Bottom wall 319 forms the lower bound of recess 318. Latching member 330 is disposed in recess 318 and includes a base 331 disposed on bottom wall 319, a first support arm 332 extending rearwardly from the base 331 along insertion direction Y.

Figure 12:
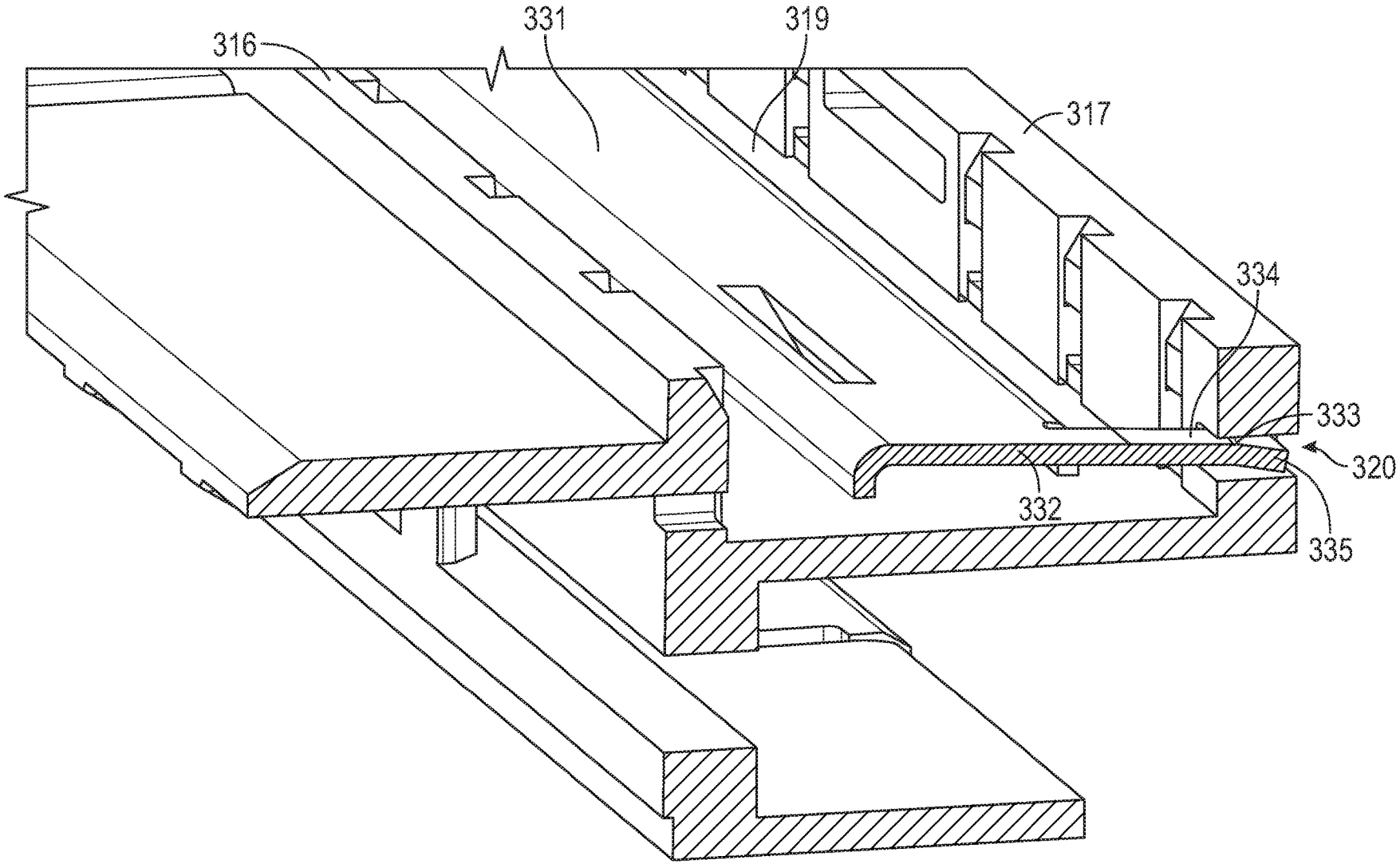
FIG. 12 is a perspective view of a latching member of a plug housing assembly, in accordance with an embodiment of the present description.

Turning to FIG. 12, first support arm 332 includes an end portion 333 disposed in an opening 320 defined in rear wall 317 and a joining portion 334 joining base 331 to end portion 333. The end portion 333 defines a free end portion 335 bent toward the bottom wall 319 of recess 318.

Figure 13A:
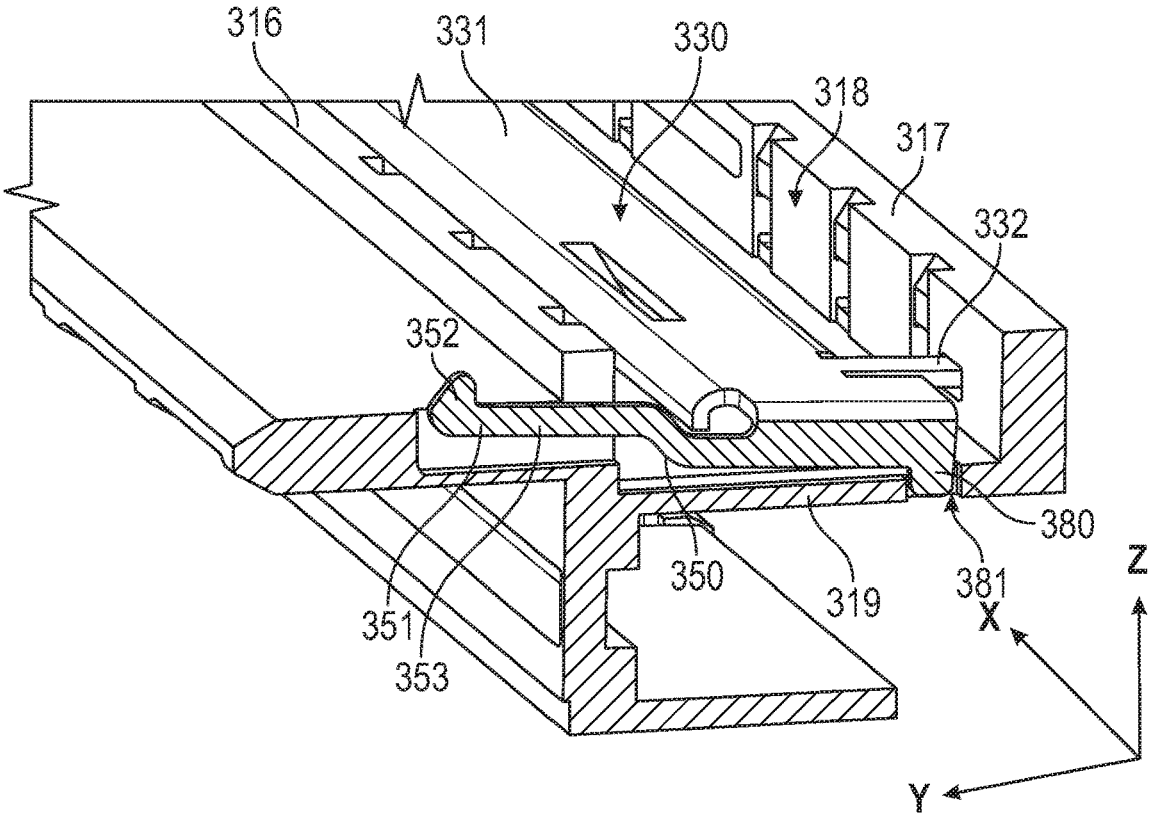
FIGS. 13A-13B are perspective views of the features of a latching member, in accordance with an embodiment of the present description.
Figure 13B:
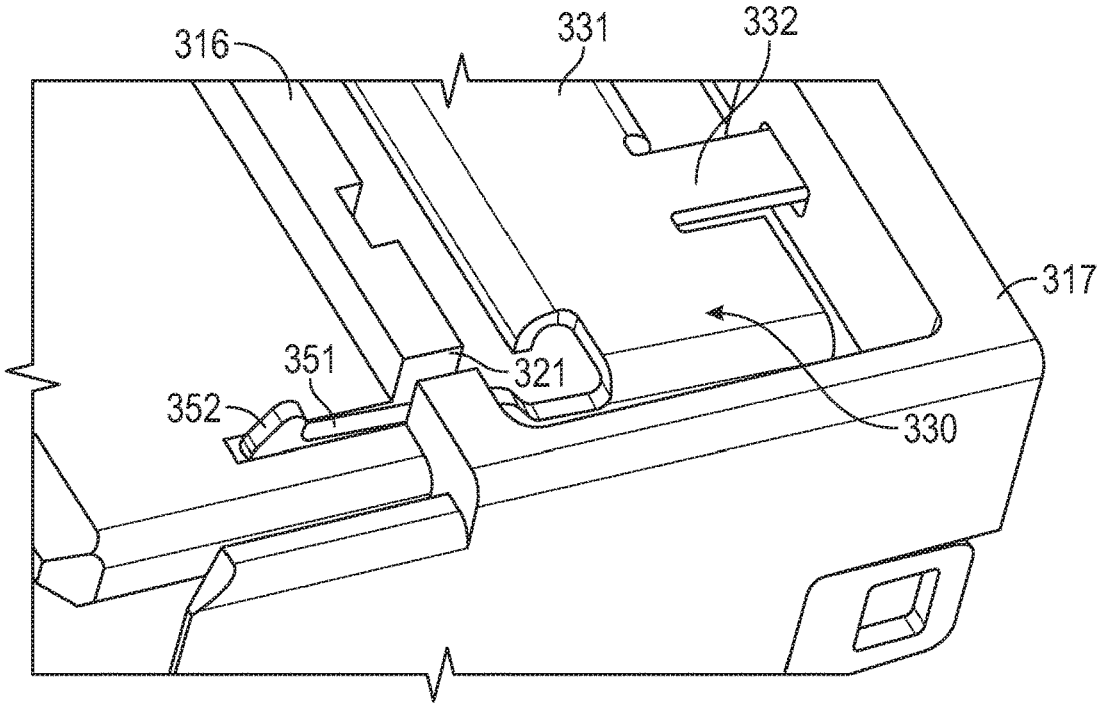

In FIGS. 13A and 13B, additional details and views of latching member 330 are shown. In some embodiments, latching member 330 further includes latching arm 350 extending forwardly from base 331 along insertion direction Y toward and past front wall 316, and including an end portion 351 terminating in a latch 352 for latching onto a latching member 510 (FIG. 15) of a mating connector 500, and a joining portion 353 connecting the end portion 351 to the base 331 and disposed in an opening 321 in the front wall.

In some embodiments, latching member 330 may include a protrusion 380 extending substantially orthogonally from the base and inserted in an opening 381 defined in the bottom wall 319 of recess 318. In some embodiments, the first support arm 332 and protrusion 380 cooperate to secure the latching member 330 to plug housing 310.

Figure 14A:
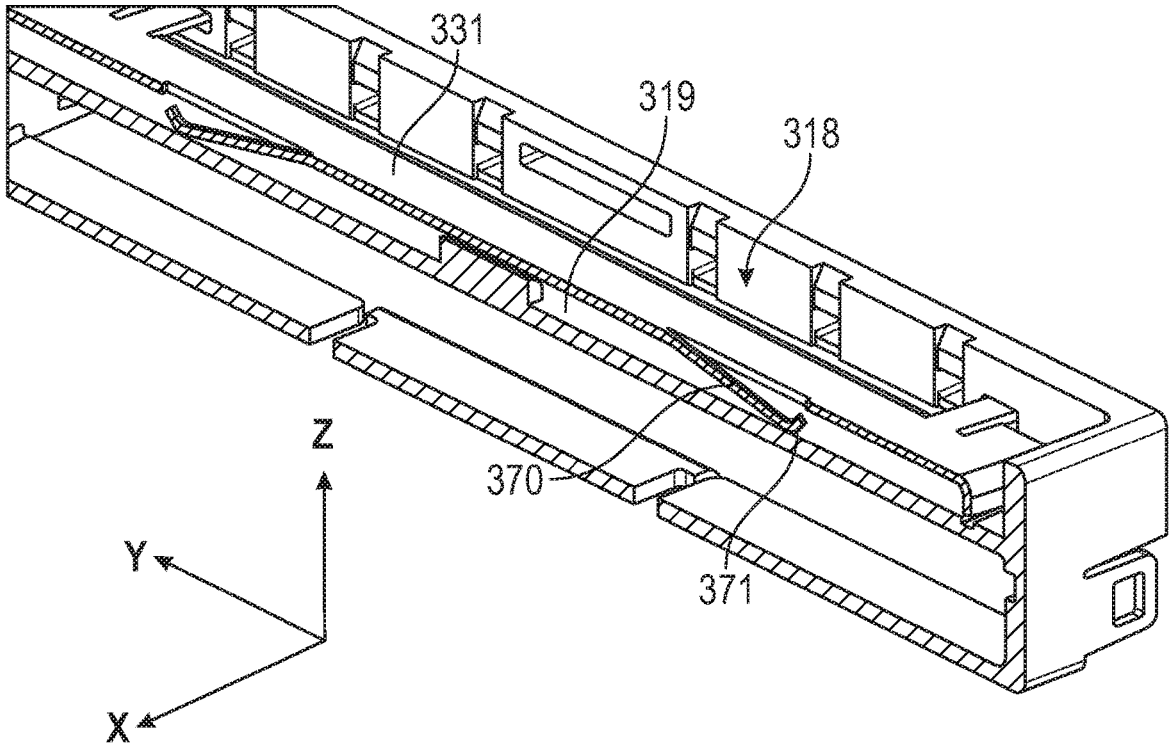
FIGS. 14A-14B are perspective views of the components of a latching member, in accordance with an embodiment of the present description.
Figure 14B:
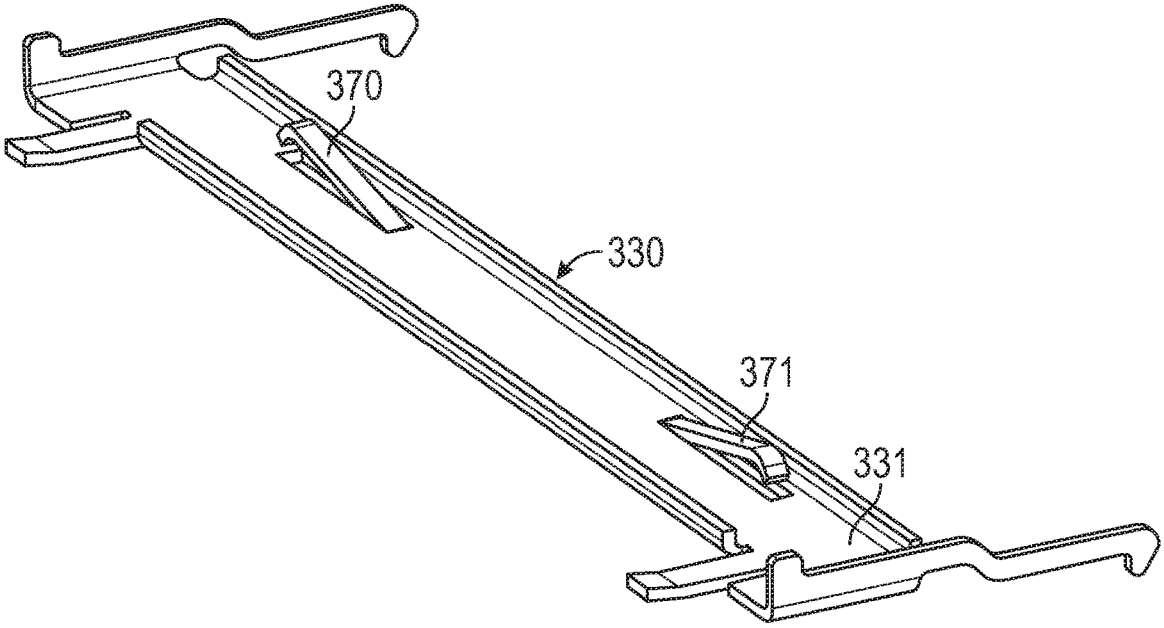
Figure 15:
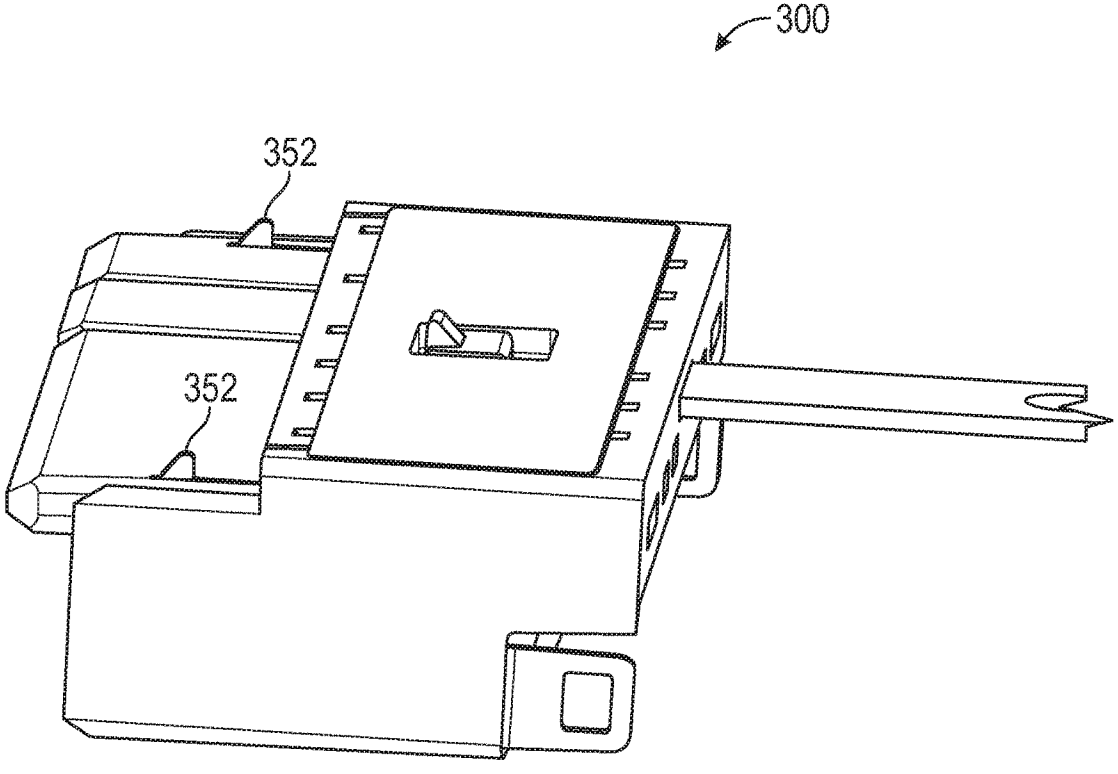
FIG. 15 is a perspective view of plug connector mating with a mating connector, in accordance with an embodiment of the present description.
Figure 15:
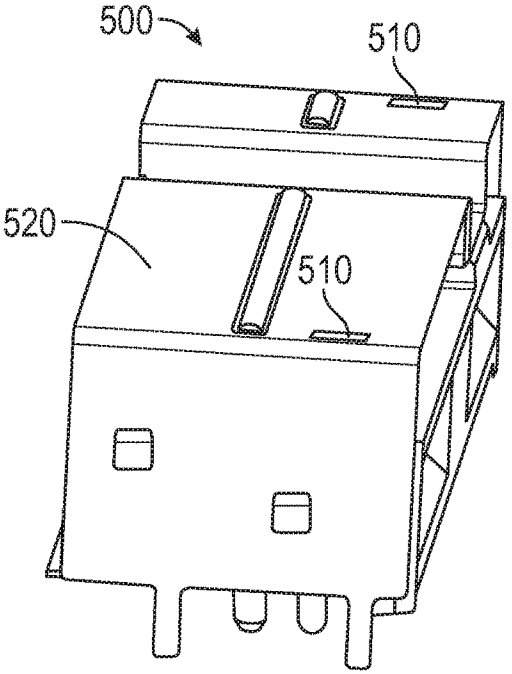

FIGS. 14A and 14B also provide additional details of latching member 330, specifically showing second support arm 370 cut out from base 331 and bent away from the base 331 toward bottom wall 319 of recess 318. The second support arm 370 includes bent portion 371 in contact with bottom wall 319 of recess 318. In some embodiments, the second support arm 370 extends along a length direction X orthogonal to the insertion direction Y and thickness direction Z.

Finally, FIG. 15 shows plug connector 300 interfacing with mating connector 500. After insertion, latches 352 of plug connector 300 will push up into latching members 510 defined in top wall 520 of mating connector 500, latching the plug connector 300 in place.

Terms such as "about" will be understood in the context in which they are used and described in the present description by one of ordinary skill in the art. If the use of "about" as applied to quantities expressing feature sizes, amounts, and physical properties is not otherwise clear to one of ordinary skill in the art in the context in which it is used and described in the present description, "about" will be understood to mean within 10 percent of the specified value. A quantity given as about a specified value can be precisely the specified value. For example, if it is not otherwise clear to one of ordinary skill in the art in the context in which it is used and described in the present description, a quantity having a value of about 1, means that the quantity has a value between 0.9 and 1.1, and that the value could be 1.

Terms such as "substantially" will be understood in the context in which they are used and described in the present description by one of ordinary skill in the art. If the use of "substantially equal" is not otherwise clear to one of ordinary skill in the art in the context in which it is used and described in the present description, "substantially equal" will mean about equal where about is as described above. If the use of "substantially parallel" is not otherwise clear to one of ordinary skill in the art in the context in which it is used and described in the present description, "substantially parallel" will mean within 30 degrees of parallel. Directions or surfaces described as substantially parallel to one another may, in some embodiments, be within 20 degrees, or within 10 degrees of parallel, or may be parallel or nominally parallel. If the use of "substantially aligned" is not otherwise clear to one of ordinary skill in the art in the context in which it is used and described in the present description, "substantially aligned" will mean aligned to within 20% of a width of the objects being aligned. Objects described as substantially aligned may, in some embodiments, be aligned to within 10% or to within 5% of a width of the objects being aligned.

All references, patents, and patent applications referenced in the foregoing are hereby incorporated herein by reference in their entirety in a consistent manner. In the event of inconsistencies or contradictions between portions of the incorporated references and this application, the information in the preceding description shall control.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A retainer assembly (200) configured to be inserted into a plug housing (310) to form a plug connector (300), comprising:

a retainer housing (10) comprising:

a top housing portion (20) defining at least one top through opening (21*a*, 21*b*, 21*c*) therein and comprising at least one top latching member (22, 23); and a bottom housing portion (40) defining at least one bottom through opening (31*a*, 31*b*, 31*c*) therein and comprising at least one bottom latching member (42, 43) engaging the at least one top latching member;

a circuit board (60) partially disposed between the top and bottom housing portions and comprising:

opposing major top (61) and bottom (62) surfaces;

a front mating end (63) disposed outside the retainer housing and configured to mate with a mating connector, and a rear cable end (64) disposed inside the retainer housing;

a plurality of conductive top (65) and bottom (66) front pads disposed on the respective top and bottom surfaces near the front mating end; and a plurality of conductive top (67) and bottom (68) rear pads disposed on the respective top and bottom surfaces near the rear cable end and electrically connected to the plurality of conductive top and bottom front pads;

at least one substantially flat top cable (81, 82, 83) comprising a plurality of conductors (84), uninsulated front ends (85) of the conductors terminated at the top rear pads in at least one top termination region (86*a*, 86*b*, 86), each top termination region aligned with and exposed through a corresponding top through opening in the at least one top through opening;

at least one substantially flat bottom cable (91, 92, 93) comprising a plurality of conductors (94), uninsulated front ends (95) of the conductors terminated at the bottom rear pads in at least one bottom termination region (96*a*, 96*b*, 96*c*), each bottom termination region aligned with and exposed through a corresponding bottom through opening in the at least one bottom through opening; and an adhesive (100) at least partially filling each through opening in the at least one top and bottom through openings and bonding the uninsulated front ends of the conductors in the corresponding exposed termination region to the circuit board.

2. A retainer assembly (200) configured to house a circuit board (60) and a cable (81-83, 91-93) terminated at the circuit board, the retainer assembly configured to be inserted into a plug housing (310) along an insertion direction (y), orthogonal to a thickness direction (z) of the retainer assembly, to form a plug connector (300), the retainer assembly comprising:

a first retainer (20) comprising a first base (24) elongated along a length direction (x) orthogonal to the insertion and thickness directions, and opposing first lateral sides (25, 26) extending from opposite edges (27, 28) of the first base along the thickness direction and orthogonal to the first base, each first lateral side comprising a first latching member (22, 23) and defining a cutout (29, 30) therein; and a second retainer (40) assembled to the first retainer and comprising a second base (44) elongated along the length direction substantially parallel to the first base, and opposing second lateral sides (45, 46) extending from opposite edges (47, 48) of the second base along the thickness direction and orthogonal to the second base, each second lateral side comprising a second latching member (42, 43) and defining a protrusion (49, 50);

wherein the second retainer is assembled to the first retainer by first partially inserting the protrusion of each second lateral side in the cutout of the corresponding first lateral side while the second base makes an oblique angle (θ) with the first base, and then rotating the second retainer substantially about an axis (110) connecting the cutouts of the first lateral sides to reduce the oblique angle while at the same time further inserting the protrusions in the cutouts until the first and second latching members latch onto each other.

3. The retainer assembly of claim 2 further comprising:

a circuit board disposed between the first and second retainers; and at least one substantially flat cable terminated at the circuit board.

4. A plug housing assembly (400) configured to receive a retainer assembly (200) comprising a circuit board (60) and at least one cable (81-83, 91-93) terminated at the circuit board, along an insertion direction (y), orthogonal to a thickness direction (z) of the plug housing assembly, to form a plug connector (300), the plug housing assembly comprising:

a plug housing (310) comprising:

a rear opening (311) for insertion of the retainer assembly;

an opposing front opening (312);

a middle wall (313) separating the front opening from the rear opening, such that when the retainer assembly is inserted into the plug housing through the rear opening of the plug housing, rear (69) and front (70) portions of the circuit board of the retainer assembly are disposed in the respective rear and front openings of the plug housing, and a middle portion (71) of the circuit board is disposed in an opening (314) of the middle wall; and a top side (315) of the housing comprising spaced apart front (316) and rear (317) walls defining a recess (318) therebetween; and a latching member (330) disposed in the recess and comprising:

a base (331) disposed on a bottom wall (319) of the recess between the front and rear walls;

a first support arm (332) extending rearwardly from the base along the insertion direction toward the rear wall and comprising an end portion (333) disposed in an opening (320) defined in the rear wall, and a joining portion (334) joining base to the end portion, the end portion comprising a free end portion (335) bent toward the bottom wall of the recess;

a latching arm (350) extending forwardly from the base along the insertion direction toward and past the front wall and comprising an end portion (351) terminating in a latch (352) for latching onto a latching member (510) of a mating connector (500) of the plug connector, and a joining portion (353) connecting the end portion to the base and disposed in an opening (321) defined in the front wall; and a second support arm (370) cut out from the base and bent away from the base toward the bottom wall of the recess, the second support arm comprising a bent portion (371) in contact with the bottom wall of the recess.

5. The plug housing assembly of claim 4, wherein the latching member further comprises a protrusion (380) extending substantially orthogonally from the base and inserted in an opening (381) defined in the bottom wall of the recess.

6. The plug housing assembly of claim 5, wherein the first support arm and the protrusion cooperate to secure the latching member to the plug housing.

7. The plug housing assembly of claim 4, wherein the second support arm extends along a length direction (x) orthogonal to the insertion and thickness directions.

8. The plug housing assembly of claim 4, wherein the latching member of the mating connector of the plug connector comprises a through opening defined in a top wall (520) of the mating connector.

* * * * *